United States Patent [19]

Johnson

[11] 4,033,154

[45] July 5, 1977

[54] ELECTRONIC CONTROL SYSTEM FOR DYEING AND PRINTING MATERIALS

[75] Inventor: Harold L. Johnson, Spartanburg, S.C.

[73] Assignee: Deering Milliken Research Corporation, Spartanburg, S.C.

[22] Filed: May 4, 1976

[21] Appl. No.: 683,224

Related U.S. Application Data

[63] Continuation of Ser. No. 477,461, June 7, 1974, abandoned.

[52] U.S. Cl. ..... 68/205 R

[51] Int. Cl.[2] ..... D06B 1/02

[58] Field of Search ..... 68/205 R, 203; 118/7, 118/8

[56] References Cited

UNITED STATES PATENTS

| | | | |
|---|---|---|---|
| 3,570,275 | 3/1971 | Weber et al. | 68/205 R |
| 3,741,139 | 6/1973 | Frentress | 112/79 A |
| 3,785,179 | 1/1974 | Davis et al. | 68/205 R X |

FOREIGN PATENTS OR APPLICATIONS

| | | | |
|---|---|---|---|
| 1,354,890 | 5/1974 | United Kingdom | 68/205 R |

*Primary Examiner*—Philip R. Coe

*Attorney, Agent, or Firm*—Stevens, Davis, Miller & Mosher

[57] ABSTRACT

Apparatus for electronically controlling the application of dyestuffs and other liquids to moving textile materials to provide a printed pattern thereon. The system includes electronic circuitry for periodically receiving bits of pattern data and processing the information to operate a plurality of valves which control the flow of liquid into the materials. Means are provided for dispensing equal amounts of liquid across a line of textile material to those areas of the material which are to receive the liquid. These equal amounts also may be uniformly varied to change the amount of liquid applied to those areas. Furthermore, means are provided for applying additional amounts of liquid to only certain of those areas which are to receive liquid, thereby dispensing unequal amounts of liquid to such areas.

25 Claims, 16 Drawing Figures

ELECTRONIC CONTROL SYSTEM FOR DYEING AND PRINTING MATERIALS

This is a continuation of application Ser. No. 477,461 filed June 7, 1974 and now abandoned.

BACKGROUND OF THE INVENTION

This invention relates to the application of dyestuffs and other liquids to textile materials and, more particularly, to an electronic control system for printing of textile fabrics having relatively porous surfaces, such as pile carpets.

Textile fibers and fabric materials have long been colored with natural and synthetic dyes, and, in particular, printed by color decoration of the surface or surfaces of the materials in definite repeated forms and colors to provide a pattern. Such color printing of textile fabrics have been accomplished in various ways. Earlier forms of printing used carved blocks charged with colored paste pressed against the fabric. Subsequently, speed of printing was increased by development of roller printing wherein moving fabrics are sequentially contacted by engraved metal rollers each containing a different color dye to form the desired pattern thereon. Textile fabrics are also printed by sequential contact with screens each having a porous portion of a pattern and carrying a particular color dyestuff.

More recently, it has been proposed to print textile fabrics, including pile carpets, by the programmed spraying or jetting of plural colored dyes onto the surface of the moving fabric. Typical processes and apparatus are described in U.S. Pat. Nos. 2,804,764 and 3,502,044; and British Pat. No. 978,452. Generally, such apparatus consists of a plurality of dye applicator bars or manifolds spaced along the direction of movement of the textile material and each containing multiple dye nozzles or jets extending transversely across the moving material. Each jet may be activated by suitable electronic, pneumatic, or mechanical means to dispense dyes onto the moving material, and pattern control to apply the dyes in a desired sequence may be accomplished by various conventional programming devices, such as mechanical cams and drums, coded punch tapes, magnetic tapes, computers, and the like.

U.S. Pat. Nos. 3,443,878 and 3,570,275 disclose specific means for applying jets of dyes to print a fabric by use of continuously flowing dyestreams which are deflected by a stream of air or a mechanical deflector to permit impingement of the dyestream upon the fabric or recirculation to a dye supply reservoir. Control of such systems to form printed patterns may be accomplished by various of the aforementioned programming means.

SUMMARY OF THE INVENTION

The apparatus of the present invention comprises an electronic control system for a jet printing machine having a series of gun bars, each containing plural dye jets extending across the width of an endless conveyor. The gun bars are spaced along the conveyor, and textile materials are carried by the conveyor past the gun bars where dyes are applied to form a pattern thereon. On request, the electronic control system receives, in a serial bit stream, pattern data stored in a conventional storage device and demultiplexes the data for transmission to a series of distributors, there being one distributor for each gun bar. Each distributor decodes the data it receives and sends it to a gun bar connection panel including a switching means for operating valves which control the plural dye jets of the gun bar, thereby applying dyestuff to the textile materials in accordance with pattern information.

The present invention can operate on a normal or split cycle condition to vary dyestuff concentration. In the normal cycle a predetermined amount of dyestuff is applied by a gun bar across a line of textile material. Split cycle operation includes odd and even cycles. During the odd cycle a predetermined amount of dyestuff is dispensed across the line of textile material. During the even cycle an additional predetermined amount of dyestuff is applied to the material at selected areas of such line to increase the concentration in those areas. Means are also provided for controlling the time in which the gun bars will fire during any given operating cycle. In this manner, the quantity of dyestuff applied by the gun bars in accordance with the pattern information may be varied.

DETAILED DESCRIPTION OF THE DRAWING

Figure 1:
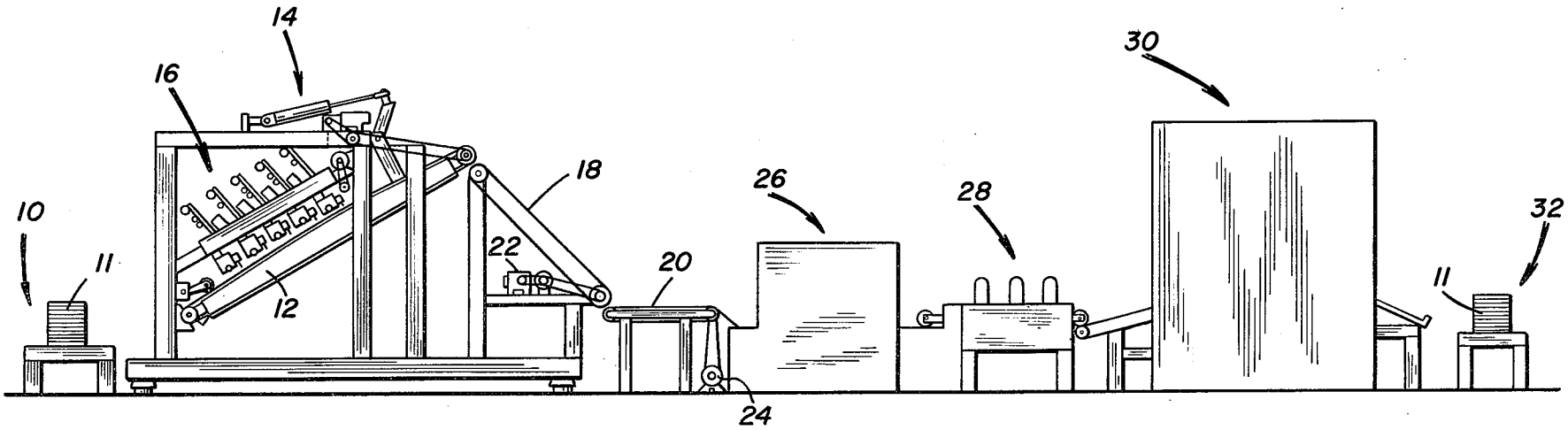
FIG. 1 is a schematic side elevation of apparatus for the jet dyeing and printing of textile materials.

Referring more specifically to the drawings, FIG. 1 shows a jet printing apparatus for printing textile materials, such as pile carpets, tiles, and the like. As seen, the apparatus consists of a supply table 10 from which a plurality of carpet tiles 11 are laid manually, or by suitable mechanical means, not shown, onto the lower end of an inclined conveyor 12 of a jet applicator section 14, where the tiles are suitably printed by the programmed operation of a plurality of jet gun bars, generally indicated at 16, which dispense streams of dye or other liquid onto the tiles during their passage. The printed tiles leaving the applicator section are moved by conveyors 18, 20, which are driven by motors 22, 24, to a steam chamber 26 where the tiles are subjected to a steam atmosphere to fix the dyes on the textile material. The printed tiles leaving steam chamber 26 are conveyed through a water washer 28 to remove excess unfixed dye from the tiles, and then pass through a hot air dryer 30 to a collection table 32 where the dried tiles are accumulated manually, or by suitable means, not shown, for subsequent use.

Figure 2:
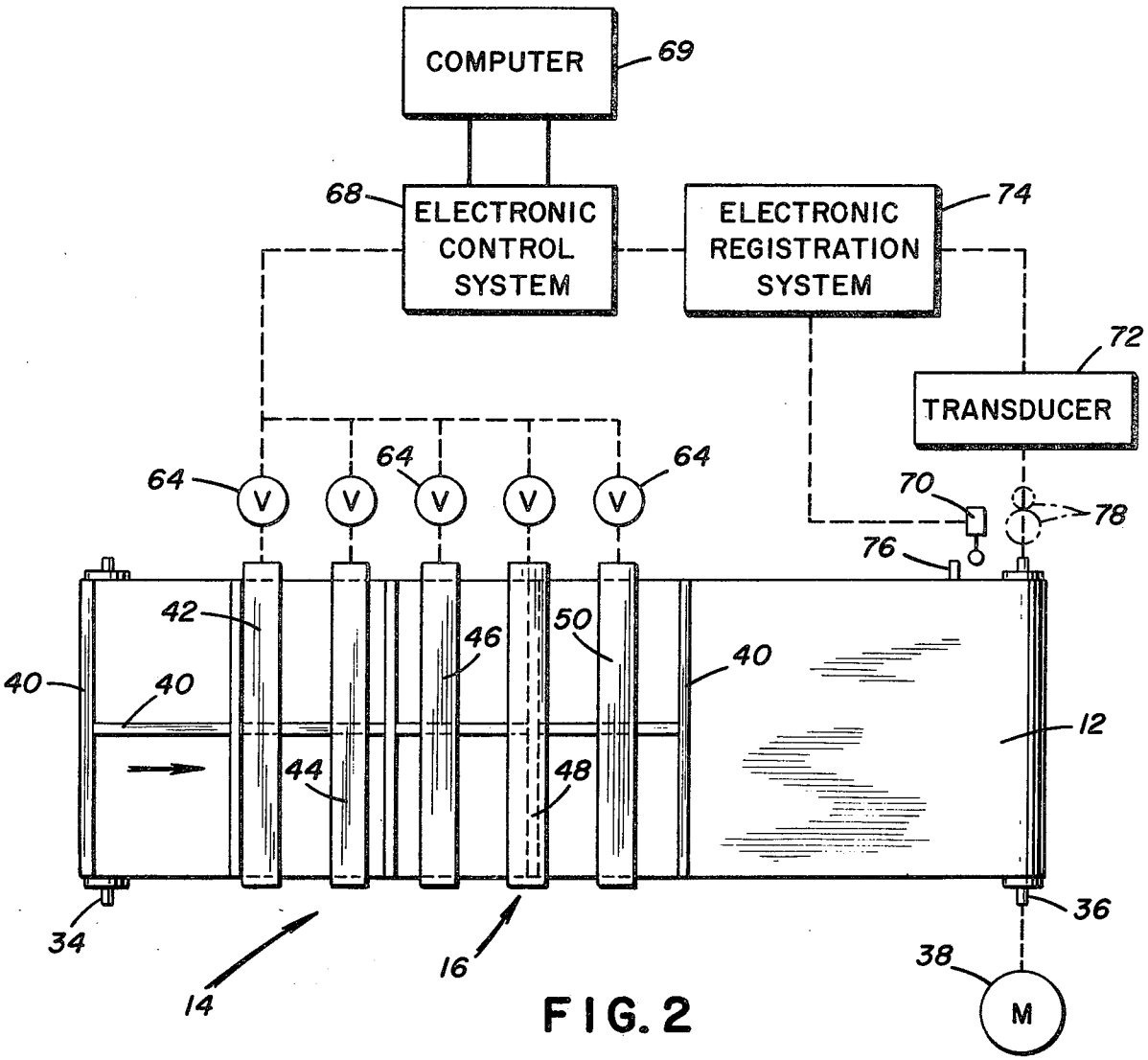
FIG. 2 is an enlarged schematic plan view of the jet dye applicator section of the apparatus of FIG. 1, showing in more detail the cooperative relation and operation of the conveyor with the jet gun bars and the pattern control components of the apparatus.
Figure 3:
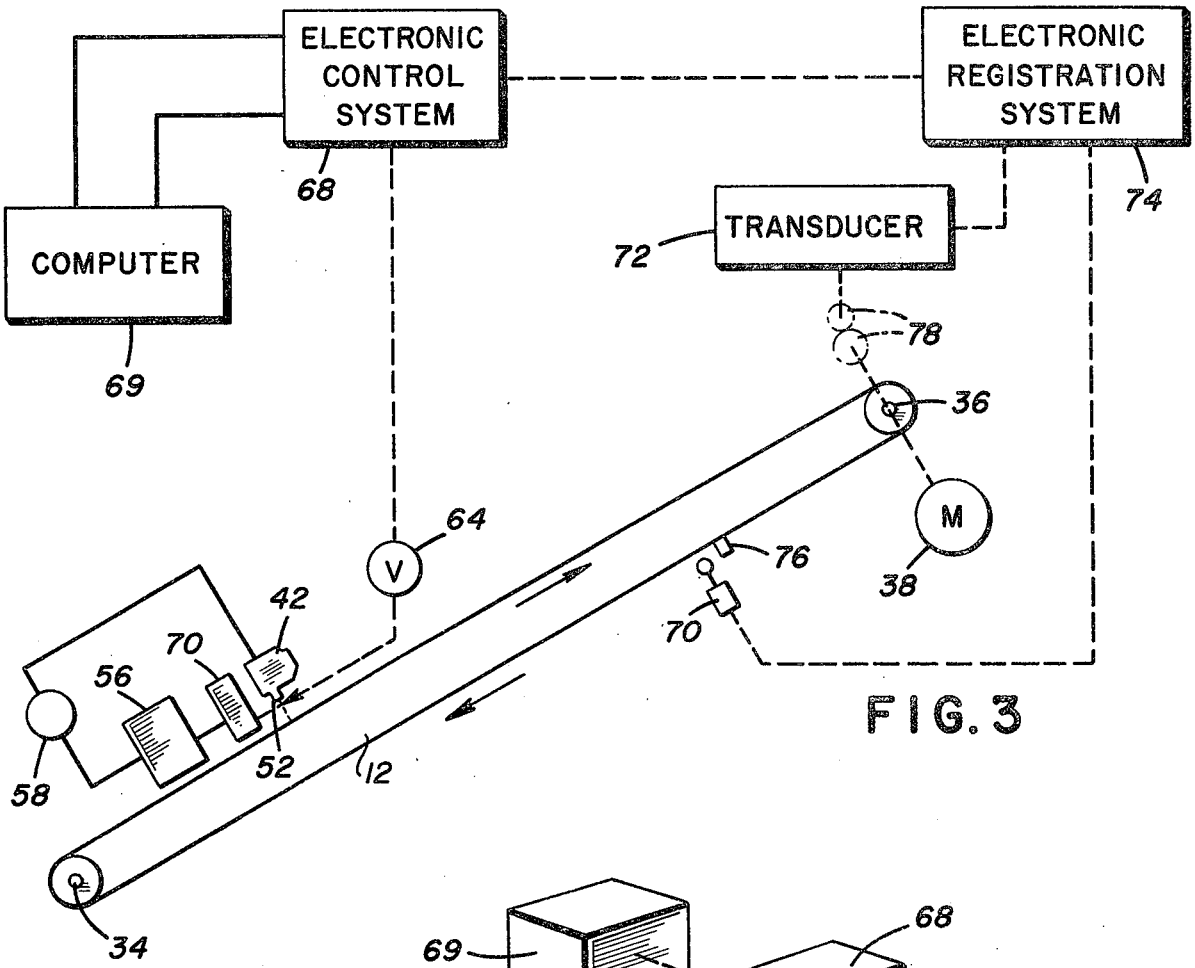
FIG. 3 is a schematic side elevation view of the jet dye applicator section seen in FIG. 2 and showing only a single jet gun bar of the applicator section and its operative connection to the dyestuff supply system for the gun bar.
Figure 4:
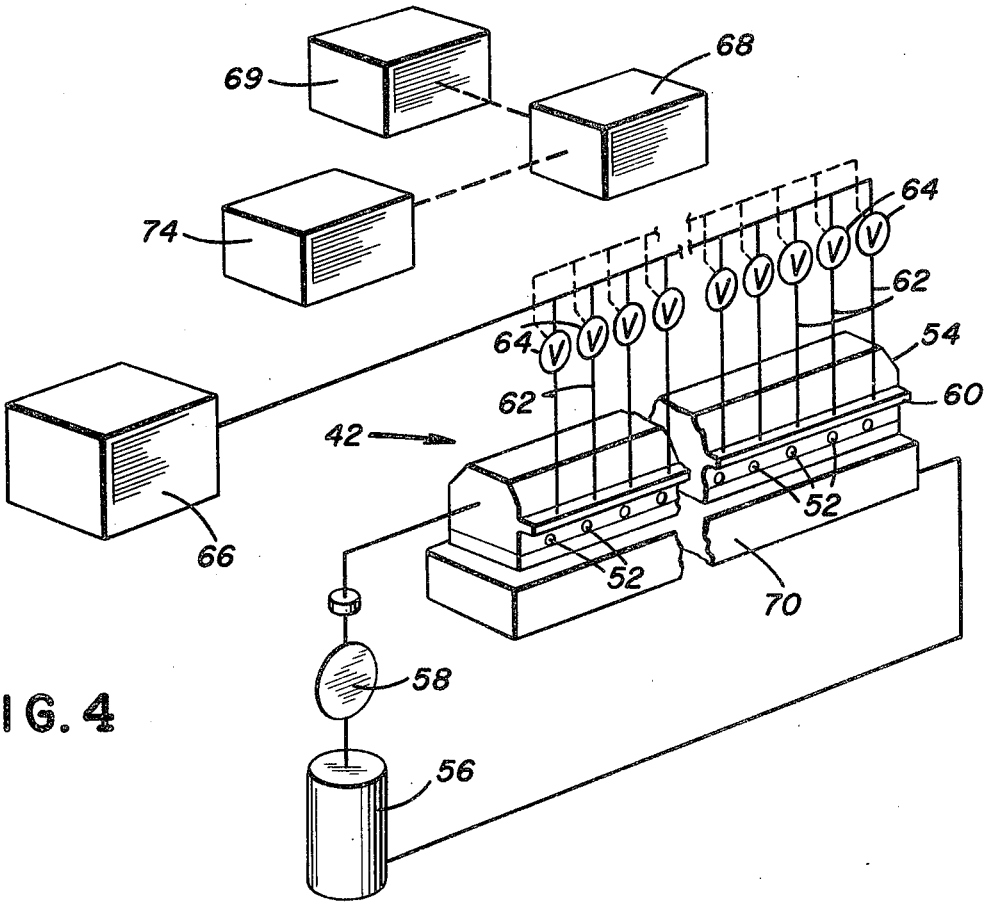
FIG. 4 is a more detailed perspective view of the jet gun bar seen in FIG. 3, and shows its operative connection to its dye supply system.

Details of the apparatus, which will be helpful in understanding the control system of the present invention, are further shown by reference to FIGS. 2–4. FIG. 2 is an enlarged schematic plan view of the jet applicator section 14 of FIG. 1 and shows the endless conveyor 12, the supporting chains and sprockets of which (not shown) are suitably supported for movement on rotatable shafts 34, 36 one of which, 36, is driven by motor means 38. For printing carpet tiles of rectangular or square shape, the surface of conveyor 12 is provided with a series of separator bars or spacers 40 which accurately position the tiles in spaced relation to each other on the supporting slats of the conveyor. During movement of the conveyor, the tiles pass sequentially adjacent and beneath substantially identical gun bars 16, spaced along the path of travel of the conveyor and extending across its full width. Though five gun bars 42, 44, 46, 48 and 50 are shown in this drawing, any number of gun bars may be used. In fact, the electronic control system of the present invention will be described in connection with eight gun bars.

As best seen in FIGS. 3 and 4 which show only the single gun bar 42, for sake of clarity, each gun bar contains a plurality of individual jet orifices 52 disposed along the bar and positioned to direct dyes in narrow streams toward the surface of the pile carpet tiles as they pass thereby. Each gun bar includes a dye supply manifold 54 (FIG. 4) communicating with the jet orifices 52 and supplied with liquid dye from a separate dye reservoir tank 56. Pump means 58 supplies liquid dye from the reservoir tank 56 under pressure to manifold 54 and the jet orifices 52. During operation, liquid dye is expelled continuously in small streams or jets from the orifices 52 toward the material to be printed in accordance with pattern information as will be described.

Positioned adjacent and at a right angle to the outlet of each jet orifice 52 is an outlet 60 of an air supply tube 62 (FIG. 4), each of which communicates with a separate solenoid valve 64 (FIG. 4). The solenoid valves, which are of the electric to fluidic interface type, such as LIF 180D3A12 made by The Lee Company of Westbrook, Connecticut are suitably supported in the jet dye applicator section 14 and are supplied with air from an air compressor 66 (FIG. 4). Although the valves for each gun bar are shown in FIGS. 2 and 3 as a single valve symbol 64, for clarity, it is to be understood that a solenoid valve and individual air supply tube are provided for each jet orifice of each gun bar such that individual streams of dye can be individually controlled, as shown in FIG. 4.

The valves are controlled by a pattern control device or electronic control system 68 of the present invention to normally provide streams of air to impinge against the continuously flowing dyestreams and deflect the same into a catch basin or trough 70 from which the dye is recirculated to the dye reservoir tank 56. The control system 68 for operating the solenoid valves receives pattern data stored in a conventional storage device such as the magnetic tape of a computer 69 which is provided with a repeating sequence of information that is transmitted to the solenoid valves until a desired number of tiles has been printed. For example, a series of 10 tiles may be placed in spaced relation to each other on the conveyor belt 12 and the control system 68 is periodically activated to request the data as the tiles present themselves beneath the gun bars 16. The pattern data is processed by the control system 68 to turn the solenoid valves off and on to sequentially print the tiles with the desired pattern as they pass beneath the sets of the gun bars.

In the operation of the presently disclosed apparatus with the electronic control system 68 processing no pattern data, dye under pressure is continuously supplied in a stream from each jet orifice 52 toward the textile material to be printed. Every solenoid valve is normally open to supply streams of air to impinge against the continuously flowing dye streams and deflect them all into the trough of the gun bars for recirculation. As the first of the series of tiles to be printed passes beneath the first gun bar and the electronic control system 68 is actuated, certain of the normally open solenoid air valves are closed so that the corresponding dye streams are not deflected, but impinge directly upon the textile material. Thus, by opening and closing the solenoid air valves in a desired sequence, a printed pattern of dye is placed on the textile material during its passage.

Dyestuff must be placed on the tile material at the precise location desired for good pattern definition and registration. This is accomplished by periodically activating the electronic control system 68 to request pattern data when the tile material has moved a predetermined incremental amount on the conveyor 12. The apparatus for enabling the electronic control system 68 to request data is shown in FIGS. 2–4 and comprises a synchronization switch 70, a transducer 72, and an electronic registration system 74. Switch 70 is periodically engaged by a mechanical trip finger 76 attached to the edge of the conveyor 12, while transducer 72 is operatively connected to the shaft 36 via gears 78 to convert mechanical movement of conveyor 12 to an electrical signal.

A detailed description of the apparatus for enabling the electronic control means 68 is disclosed in U.S. Application Ser. No. 430,526, filed 1/3/74 by Harold L. Johnson and assigned to the assignee of the present invention. As taught therein, the transducer 72 and registration system 74 function to generate an enabling pulse every one-tenth inch of travel of the conveyor 12, which pulse is transmitted to control system 68. Consequently, system 68 is enabled to request and then receive pattern data for dispensing dyestuff each one-tenth inch movement of the conveyor 12. The synchronization switch 70 is activated by the trip finger 76 just as the first carpet tile of a series of tiles comprising the desired pattern reaches the first gun bar 42 to reset the registration system 74. Synchronization switch 70 is activated by finger 76 each time the first tile of a new series of tiles embodying the pattern appears below gun bar 42.

Figure 5:
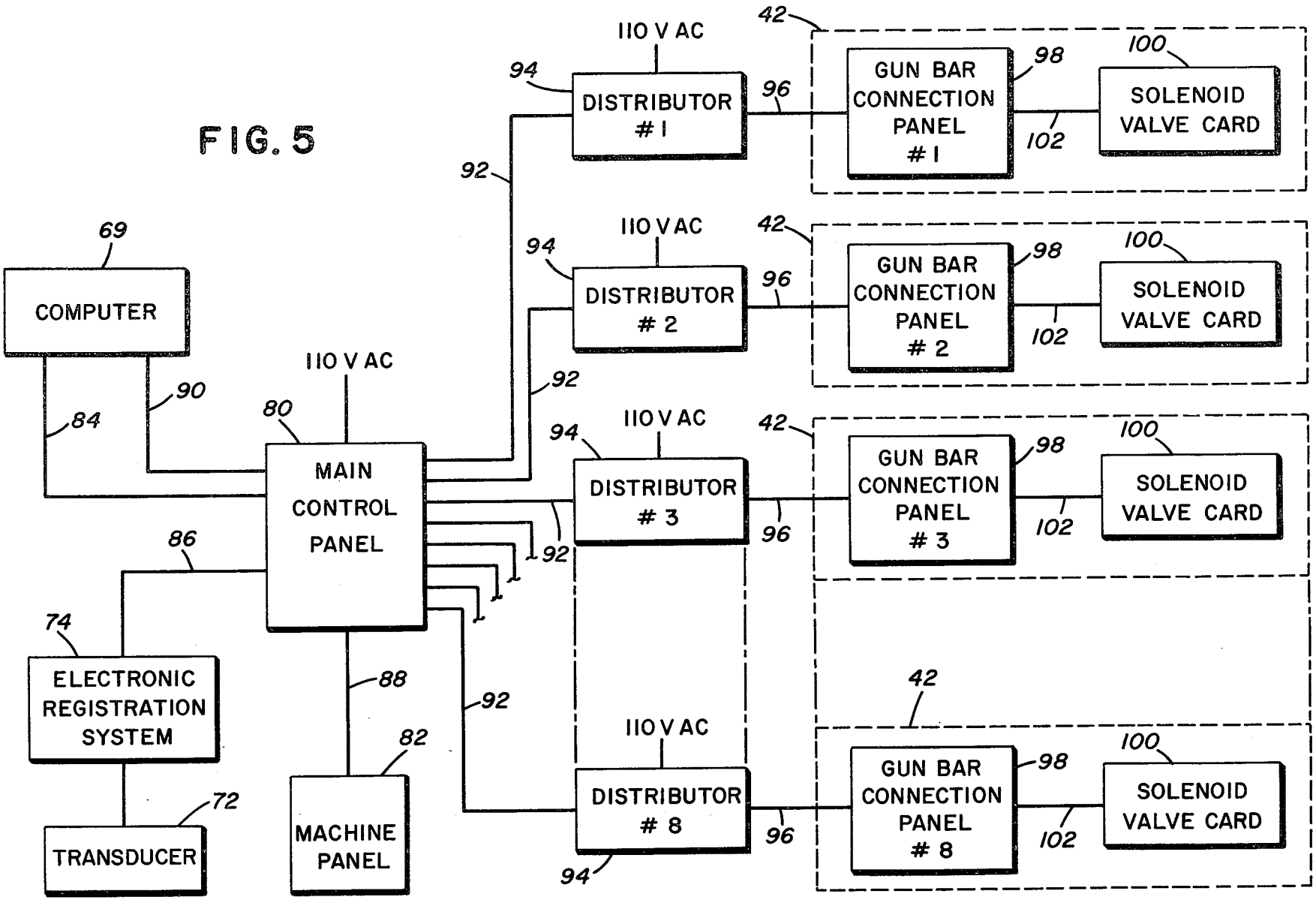
FIG. 5 is a block diagram of the electronic control system of the present invention.

FIG. 5 is a block diagram of the electronic control system 68 of the present invention. A main control panel 80 has an input connected, respectively, to the computer 69, electronic registration system 74 and a machine panel 82 through lines 84, 86 and 88 respectively, and an output over line 90 to the computer 69. Control panel 80 has eight additional outputs coupled, respectively, over conductors 92 to eight distributors 94. Eight gun bars, such as gun bar 42, are connected, respectively, to the distributors 94 over lines 96 and each includes a gun bar connection panel 98 coupled to a solenoid valve card 100 over conductor 102.

In the specific embodiment, each of the eight gun bars 42 includes 1560 nozzles 52, each separated by one-tenth inch and individually controlled by 1560 solenoid valves. As will be more fully described, the pattern data from computer 69 comprises 8 × 1568 bits and clock pulses with each of the first 1560 bits transmitted to a distributor 94 controlling a respective solenoid valve and thereby the jet stream of dyestuff from the nozzles 52.

When the conveyor 12 has moved one-tenth inch, electronic registration system 74 sends an enabling pulse to control panel 80 which then requests over line 90 pattern data from the computer 69. The computer then provides an output serial bit stream of pattern data, including clock pulses, which is fed via line 84 to the control panel 80. Alternatively, main control panel 80 may generate test pattern data. Registration system 74 may be disabled and a switch (not shown) closed in the machine panel 82 to enable the test pattern data to be transmitted to the distributors 94. Such test pattern data has the same format as the data from computer 69 and is used to test the system components.

Figure 6A:
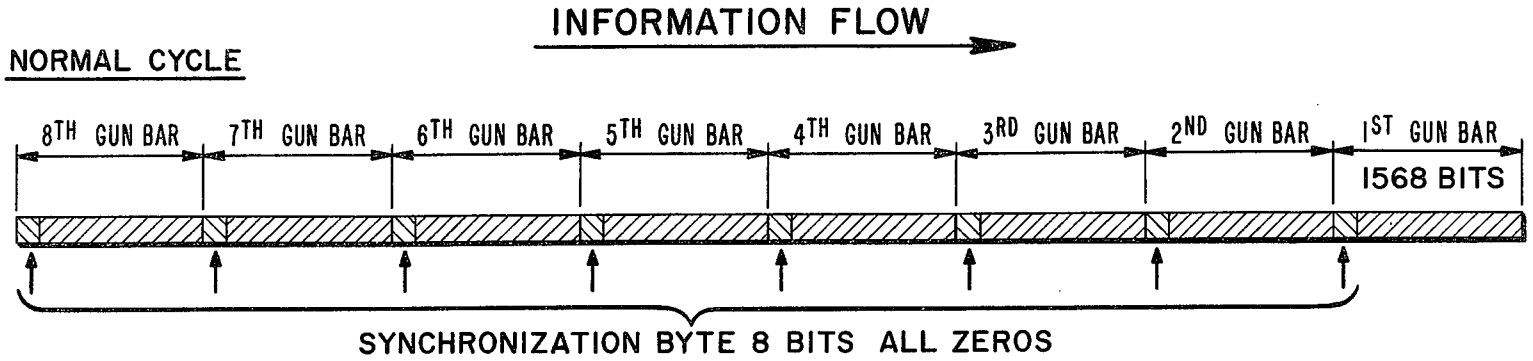
FIGS. 6A and 6B shown, respectively, the pattern data format for normal and split cycle operation.
Figure 6B:
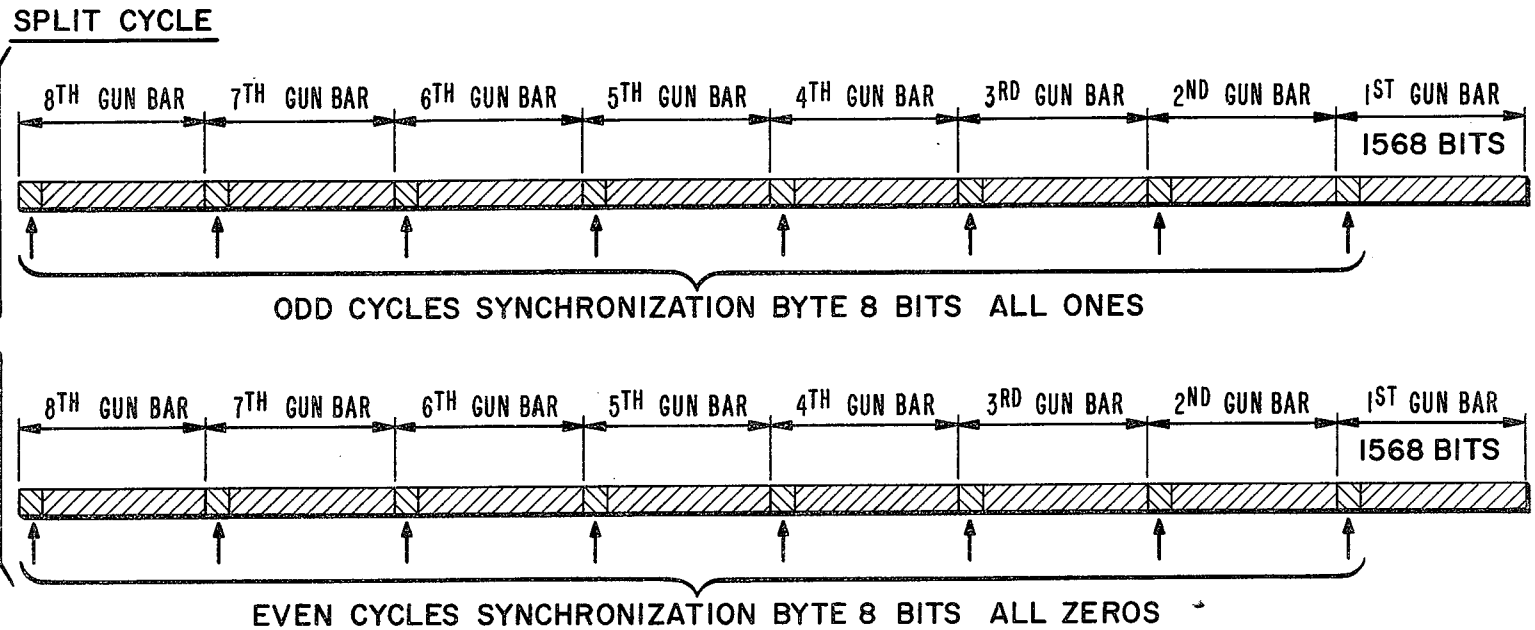

FIG. 6A shows the serial data format from computer 69 for normal cycle operation. FIG. 6B illustrates the data format for split cycle operation which will be discussed after the normal cycle is described. The control panel 80 demultiplexes the data and clock pulses into eight groups of 1568 bits with each group being transmitted to one of the eight distributors 94. The first 1560 bits of each group provide pattern information for each of the 1560 nozzles 52 in a gun bar while the last eight bits or byte are not used in the normal cycle mode.

Figure 7A:
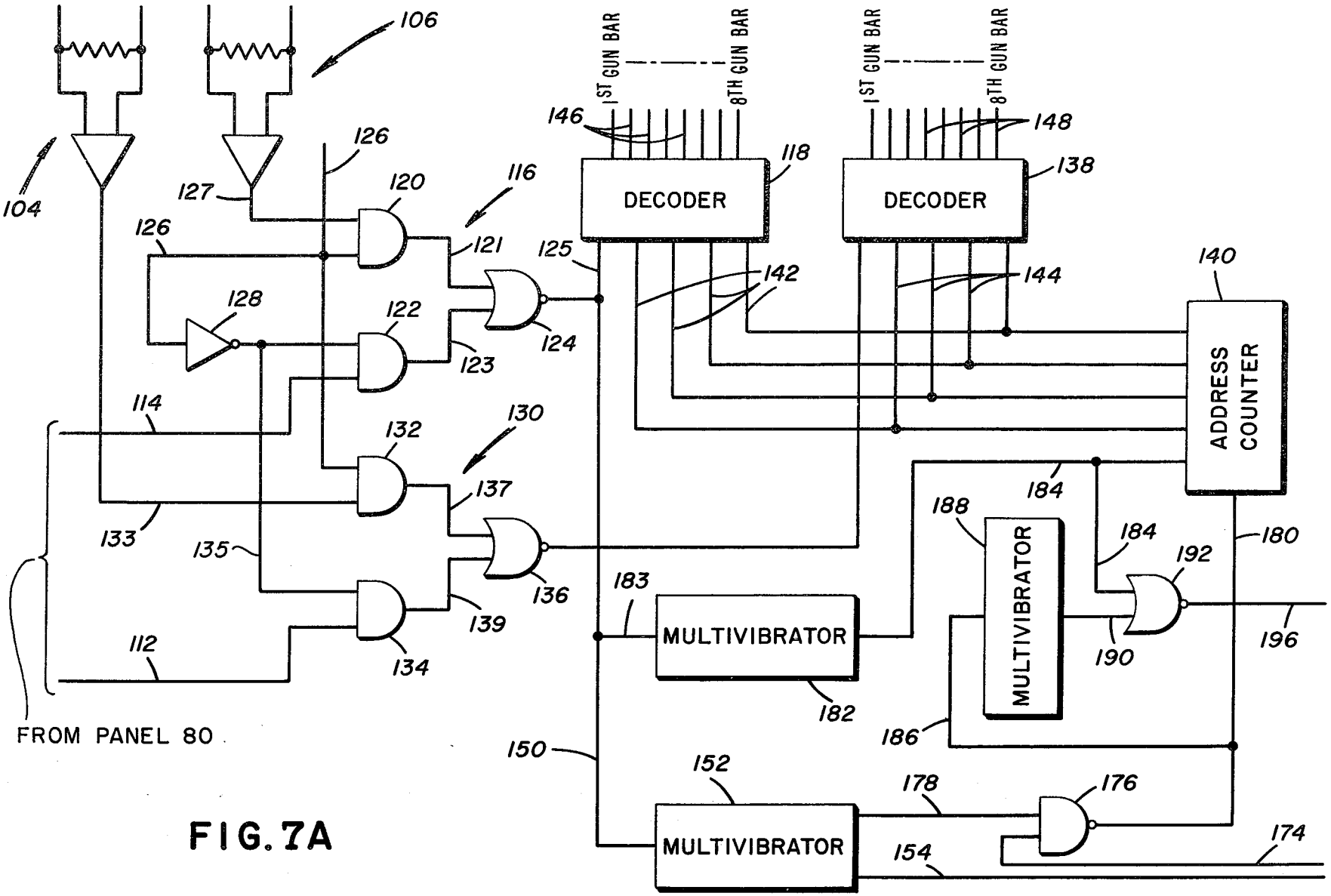
FIGS. 7A and 7B are schematic diagrams of a demultiplexer of the control panel of FIG. 5.
Figure 7B:
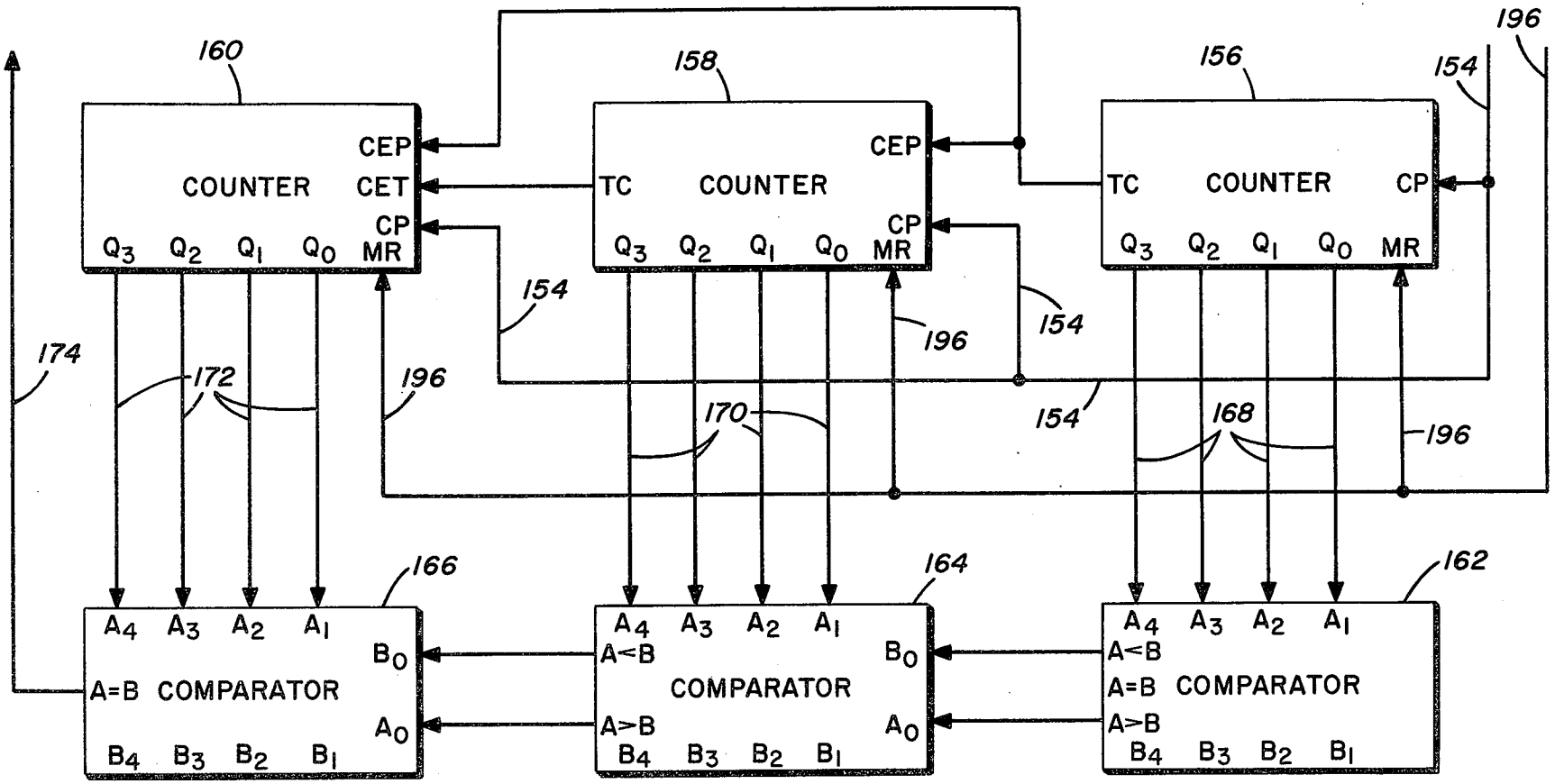

FIGS. 7A and 7B disclose schematically the circuitry of control panel 80 for demultiplexing the pattern data and clock. Control panel 80 includes a pair of differential line receivers 104, 106 which receive, respectively, pattern data and clock pulses from the computer 69. Control panel 80 may also generate test pattern data and clock pulses to be transmitted to the distributors 94 over lines 112 and 114 respectively.

Clock pulses from either differential line receiver 106 or line 114 are fed via a first logic circuitry 116 to a first decoder 118. Logic circuitry 116 includes two AND gates 120, 122 whose outputs are coupled over lines 121, 123 to a NOR gate 124 which in turn is connected over path 125 to the decoder 118. AND gate 120 receives via line 127 one input from differential line receiver 106 and another input from a line selector 126. AND gate 122 has one input connected to line 114 for receiving clock pulses generated by panel 80 and a second input connected to the line selector 126 through an inverter 128.

Pattern data from computer 69 or test pattern data over line 112 is transmitted through second logic circuitry 130 including two AND gates 132, 134 and a NOR gate 136 to a second decoder 138. AND gate 132 has one input coupled over wire 133 to the output of differential line receiver 104 and a second input connected to the line selector 126. Gate 134 has one input connected to line 112 for receiving data generated by panel 80 and a second input coupled to the output of inverter 128 via path 135. The output of each gate 132, 134 is coupled over lines 137, 139 to gate 136.

Each of the decoders 118, 138 receives address information from an address counter 140 over lines 142, 144 respectively, and routes the received bits to the eight respective distributors over lines 146, 148 in accordance with such address information. Address counter 140 will increment its count by one after a predetermined number of clock pulses is received by the panel 80 to identify one of the lines 146, 148 and then thereby switch a number of data bits and clock pulses to those one lines. To increment the address counter 140, the output of gate 124 is also connected over conductor 150 to a one-shot multivibrator 152 whose positive output pulse over line 154 is fed to counters 156, 158 and 160 shown in FIG. 7B. Counters 156, 158 and 160 are coupled respectively to comparators 162, 164, 166 via lines 168, 170 and 172, which compare the count to a fixed count hard wired in the comparators. In a manner which would be well-known, when counters 156, 158, 160 have counted the fixed count, an output pulse from comparator 166 is transmitted over line 174 to a NAND gate 176 (FIG. 7A) whose other input is connected to multivibrator 152 via line 178. The output of gate 176 is delivered over wire 180 to the counting input of address counter 140 to increment it by one.

When no further clock pulses are received from the computer 69 (or generated by panel 80), thereby indicating that all the pattern data has been supplied until the next one-tenth inch movement of the conveyor 12, address counter 140 is reset. To reset counter 140, the output of gate 124 is also coupled to a retriggerable multivibrator 182 over line 183, the output of which is connected to a master reset input of counter 140 via path 184. Multivibrator 182 continually retriggers and, therefore, provides no negative going output signal as long as clock pulses are received at its input. Furthermore, counters 156, 158 and 160 are reset after they have counted to the fixed count wired in the comparators 162, 164, 166. To reset these counters, the output of gate 176 is also fed over line 186 to a one shot multivibrator 188. The output of one sot multivibrator 188 is then transmitted over line 190 to a NOR gate 192 which receives as a second input via line 184 the output from retriggerable multivibrator 182. The output of gate 192 is fed to the master reset inputs of counters 156, 158, and 160 via wire 196. The reason for the second input via line 184 to gate 192 is to maintain counters 156, 158 and 160 reset when the printing and dyeing machine is not being used. At this time, multivibrator 152 holds a hard reset for such counters as well as counter 140. This prevents these counters from counting a signal due, for example, to noise, which count is undesirable at the start of machine operation.

The operation of the control panel 80 will now be described. Since in this specific embodiment there are eight gun bars, the control panel 80 will receive a block of serial data from the computer 69 or will generate test data for demultiplexing into the eight group format shown in FIG. 6A to form part of the desired pattern. Assuming that actual rather than test pattern data is to be used, each time the control panel 80 is enabled by the electronic registration system 74, the panel 80 will request and receive from the computer 69 a serial stream of data including clock pulses of 8 × 1568 bits. Furthermore, at machine panel 82 the switch is opened to disable test pattern data.

The pattern data is received over differential line receiver 104 and fed to gate 132 whose other input is the enabling signal from line selector 126. AND gate 132 is thereby enabled to transmit the serial pattern data to gate 136 and then to decoder 138.

Decoder 138 routes the received data to the various outputs 148 for transmission to the appropriate distributors 94. As can be appreciated from the data format of FIG. 6A, the first 1568 bits of the serial bit stream may be switched to the first distributor, the second 1568 bits to the second distributor, and so on until all eight distributors receive pattern data. Decoder 138 receives address information from the address counter 140 which therefore must increment its count by one every 1568 bits to provide a new address that identifies a new line 148. When the first bit of the pattern data is received at the input to the decoder 138, address counter 140 will provide address information identifying the decoder output leading to distributor No. 1. After 1568 pattern bits are received, address counter 140 will increment its count by one to provide address information identifying the output of decoder 138 leading to distributor No. 2, and so on.

Address counter 140 is incremented by one every 1568 bits in the following manner. Clock pulses, synchronized with each of the data bits, are received over differential line receiver 106 and fed to one input of AND gate 120. Since an enabling signal from line selector 126 is also fed to the other input of AND gate 120, the clock pulses are fed through gate 124 over line 150 to one shot multivibrator 152 which is enabled at the negative transition of the clock pulses. One shot multivibrator 152 then provides an output pulse for each clock pulse over line 154 to the counters 156, 158, 160. As each counter receives the clock pulses, its count is fed over lines 168, 170, 172 respectively to the comparators 162, 164, 166. Comparators 162, 164 and 166 are hard wired for a count of 1568.

When 1568 clock pulses have been counted and compared, comparator 166 provides an output pulse over line 174 to the gate 176. The other input to gate 176 is a synchronization signal from the one shot multivibrator 152 which enables the gate 176. This synchronization signal is the negative of the signal on line 154 and is generated when the latter is not emitted. It is used to pass the pulse over line 174 at the proper time and to avoid problems with any noise signals that may appear on the line and improperly enable gate 176. The output of gate 176 is then fed via line 180 to the address counter 140 to increment it by one.

During the time the counters 156, 158, 160 are counting clock pulses, pattern data is switched by the decoder 138 from its input to the output line 148 connected to distributor No. 1. After 1568 pulses are counted and hence 1568 data bits fed to distributor No. 1, decoder 138 receives new address information to route the next group of 1568 data bits to the distributor No. 2, and so on until all eight distributors receive a group of 1568 bits of pattern data.

Counters 156, 158, 160 are reset after counting to 1568 as follows. The output pulse of gate 176 is also fed over line 186 to one shot multivibrator 188 which is triggered at the negative transition of this pulse. Multivibrator 188 then generates an output pulse over line 190 through gate 192, the output of which is then fed via wire 196 to the master reset inputs of counters 156, 158, 160 to reset them.

The clock pulses receive over differential line receiver 106 are also fed from gate 124 to decoder 118 for demultiplexing into eight groups of 1568 pulses, there being one group for each of the eight distributors. In the same manner as with decoder 138, decoder 118 receives address information over line 142, which is the same address information received by decoder 138, to address each of its eight outputs every 1568 bits.

Test pattern data and clock pulses also may be demultiplexed by the decoders 118, 138. In this alternative mode, the switch on the machine panel 82 may be closed to provide a logic signal over line selector 126 for disabling gates 120, 132 and enabling gates 122, 134. This logic signal is then fed via inverter 128 to the gates 122, 134, the other inputs of which are, respectively, clock and test pattern data. The respective outputs of AND gates 122 and 134 are then fed to gates 124, 136 and then to decoders 118, 138. In the same manner that pattern data and clock pulses from the computer 69 are demultiplexed, the test pattern data and clock pulses generated by control panel 80 are demultiplexed by decoders 118, 138.

As noted above after 8 × 1568 data bits and clock pulses are received and demultiplexed, the address counter 140 is reset in anticipation of the next block of data. To reset counter 140, after 8 × 1568 clock pulses are received, multivibrator 182 is not retriggered and, therefore, provides an output pulse whose negative going transition indicates that no more information will be received. This output pulse is delivered over line 184 to the master reset input of address counter 140 to reset it at such transition.

The pattern data and clock pulses having been demultiplexed into eight groups of 1568 bits, it is the function of each distributor 94 to distribute each received group into thirteen subgroups of 120 bits per subgroup. As noted previously, since the nozzles 52 are separated by one-tenth inch, and there is one bit per nozzle, each subgroup of 120 bits corresponds to 12 inches or one foot of nozzles across the width of the conveyor 12.

FIGS. 8A-8D disclose the schematic of a line decoder for one of the distributors 94 for decoding a group of 1568 bits. As will be appreciated, the manner in which this group of 1568 bits is decoded into thirteen subgroups is similar to the manner in which control panel 80 demultiplexes its received pattern data and clock pulses.

Figure 8A:
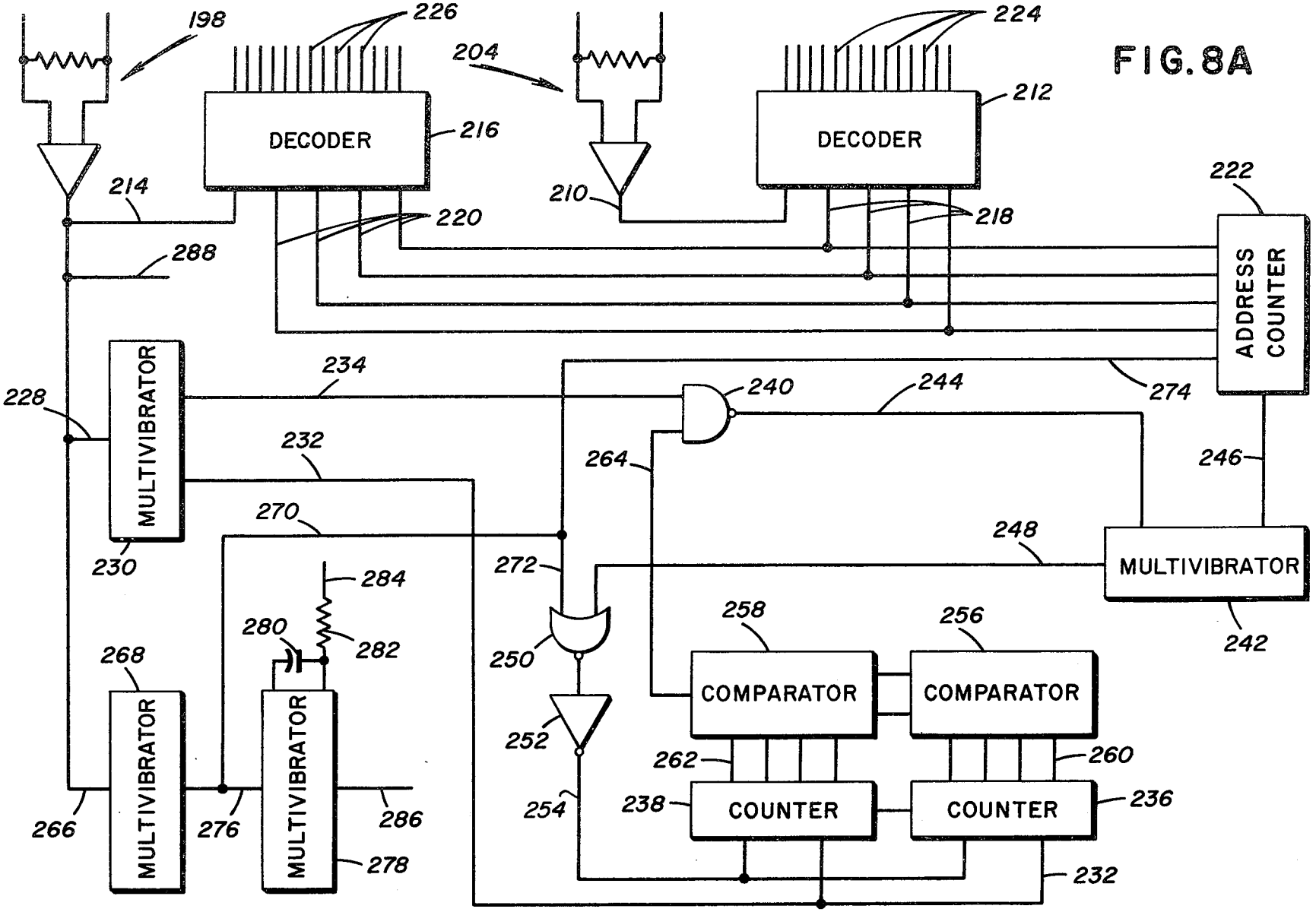
FIGS. 8A, 8B, 8C and 8D are schematic diagrams of a line decoder for a distributor of FIG. 5.

FIG. 8A shows a differential line receiver 198 for receiving clock pulses from one of the output lines 146 of decoder 118. A second differential line receiver 204 receives pattern data from one of the output lines 148 of decoder 138. The pattern data is fed from line receiver 204 over line 210 to a decoder 212 while the clock pulses are transmitted from line receiver 198 over line 214 to a second decoder 216. Each decoder 212, 216 receives address information over lines 218, 220, respectively, from an address counter 222 and switches the received bits to fourteen output lines 224, 226, respectively.

The output of the line receiver 198 is also connected via wire 228 to a one shot multivibrator 230 having a positive clock output at line 232 and a negative output at line 234. The positive output of multivibrator 230 is connected to the counting inputs of two counters 236, 238 over circuit path 232. The negative output of multivibrator 230 is coupled to a NAND gate 240 whose output is connected to a multivibrator 242 over line 244. Multivibrator 242 has one output over conductor 246 connected to the counting input of address counter 222 and a second output over line 248 connected to the input of a NOR gate 250, the output of which is coupled to an inverter 252 and then to the master reset inputs of counters 236, 238 over line 254.

Counters 236, 238 have their outputs coupled to comparators 256, 258, respectively, through lines 260, 262, which have a fixed count hard wired in. When the fixed count is counted by the counters 236, 238, an output signal is provided by comparator 258 over line 264 to the second input of gate 240.

The output of receiver 198 is also delivered over circuit path 266 to the input of a retriggerable one shot multivibrator 268 which is used to reset the counters 222, 236, 238. The output of multivibrator 268 is coupled via line 270 to the second input of NOR gate 250 over line 272 and to the master reset input of address counter 222 over line 274. Such output of the multivibrator 268 is also coupled over line 276 to a "firing" or "activating" one shot multivibrator 278 havng a capacitor 280 charged through a resistor 282 via line 284. The output of multivibrator 278 is fed over line 286 to a firing circuit as will be described. The clock output of receiver 198 is also transmitted over path 288 to an overspeed detection circuit as will be more fully described.

The circuit of FIG. 8A decodes the received pattern data and clock pulses in the following manner. The pattern data is received by differential line receiver 204 and fed in serial bit stream to decoder 212. In a similar manner, clock pulses are received by the differential line receiver 198 and then transmitted in serial bit stream to the input of decoder 216. When the pattern data and clock pulses are first received by the decoders 212, 216 address information from counter 222 identifies the first of fourteen output lines 224, 226 of the decoders 212, 216, thereby switching the data and clock to such lines. After the first 120 bits of data and clock are received, address counter 222 is incremented by 1 to generate address information defining the next output of the fourteen lines 224, 226 of decoders 212, 216. Consequently, the next 120 bits of data and clock are switched to the second of the fourteen output lines, and so on until thirteen groups of 120 bits each are routed to the thirteen output lines of each decoder 212, 216. As will be appreciated, the first thirteen output lines will transmit $13 \times 120 = 1560$ bits. The last 8 bits of data and clock of the group of 1568 bits received by one distributor are switched to the fourteenth output line 224, 226 of each decoder 212, 216 but are not used in normal cycle operation.

To increment the address counter 222, the clock pulses from receiver 198 are fed over line 228 to one shot multivibrator 230 which provides an output pulse over line 232 at the negative transition of each clock pulse. These output pulses are transmitted via conductive path 232 to the counting inputs of counters 236, 238 which count each received pulse in a well known manner. The count in the counters 236, 238 is coupled over lines 260, 262, to comparators 256, 258 which have wired in a count equal to 120. When this count of 120 is reached, comparator 258 provides an output pulse over line 264 to gate 240 which also receives an enabling synchronization signal from the output of multivibrator 230 over line 234 similar to the synchronization signal from multivibrator 152. When gate 240 is enabled, multivibrator 242 is triggered by the negative transition of the output of gate 240 and provides an output pulse over line 246 to the counting input of address counter 222 to increment the count by one. After the pulse from multivibrator 242 is completed, a reset signal is generated over line 248 through gate 250 and inverter 252 to the master reset inputs of counters 236, 238 to reset these counters for the next 120 pulses.

Address counter 222 is reset, after 1568 data and clock bits are received, with the clock output of receiver 198 which is fed via line 266 to retriggerable multivibrator 268 which is constantly retriggered and provides no output, i.e., no negative going signal, unless no clock pulses are received. This multivibrator 268 is retriggered at the negative transition of each clock pulse, but after 1568 pulses are received, no further pulses are received and, hence, an output is provided over lines 270, 274 to the master reset input of address counter 222 to reset it. The output of multivibrator 268 is also fed over lines 270, 272 to the second input of gate 250 and then to inverter 252 for resetting the counters 236, 238.

With the pattern data and clock pulses now grouped into thirteen groups of 120 bits per group, the distributor stores these bits in a series of thirteen groups of shift registers. Each register in a group is capable of storing four bits of pattern data and, therefore, the data on any one line 224 of decoder 212 is shifted into thirty registers comprising one 120 bit shift register.

Figure 8B:
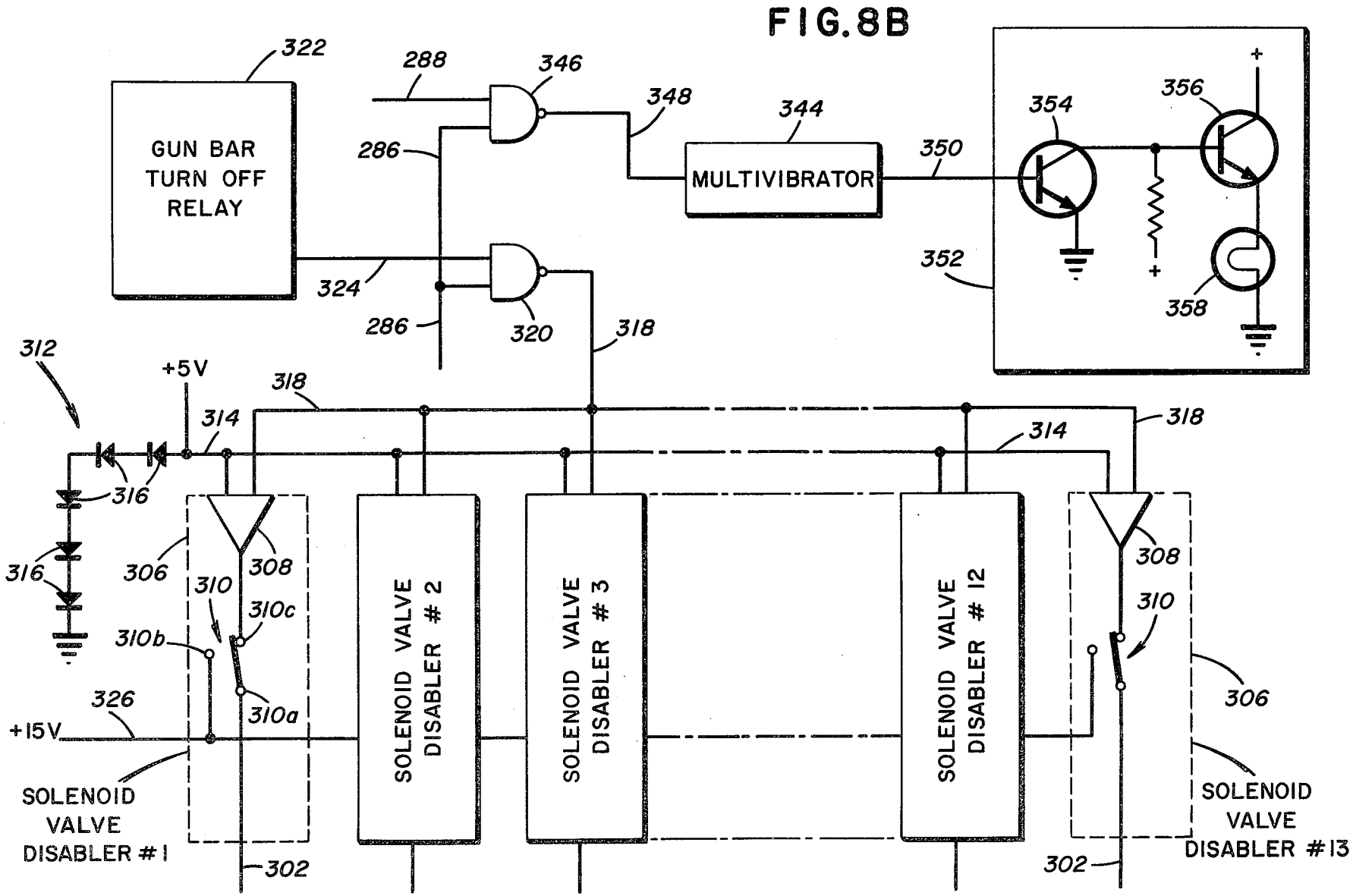
Figure 8C:
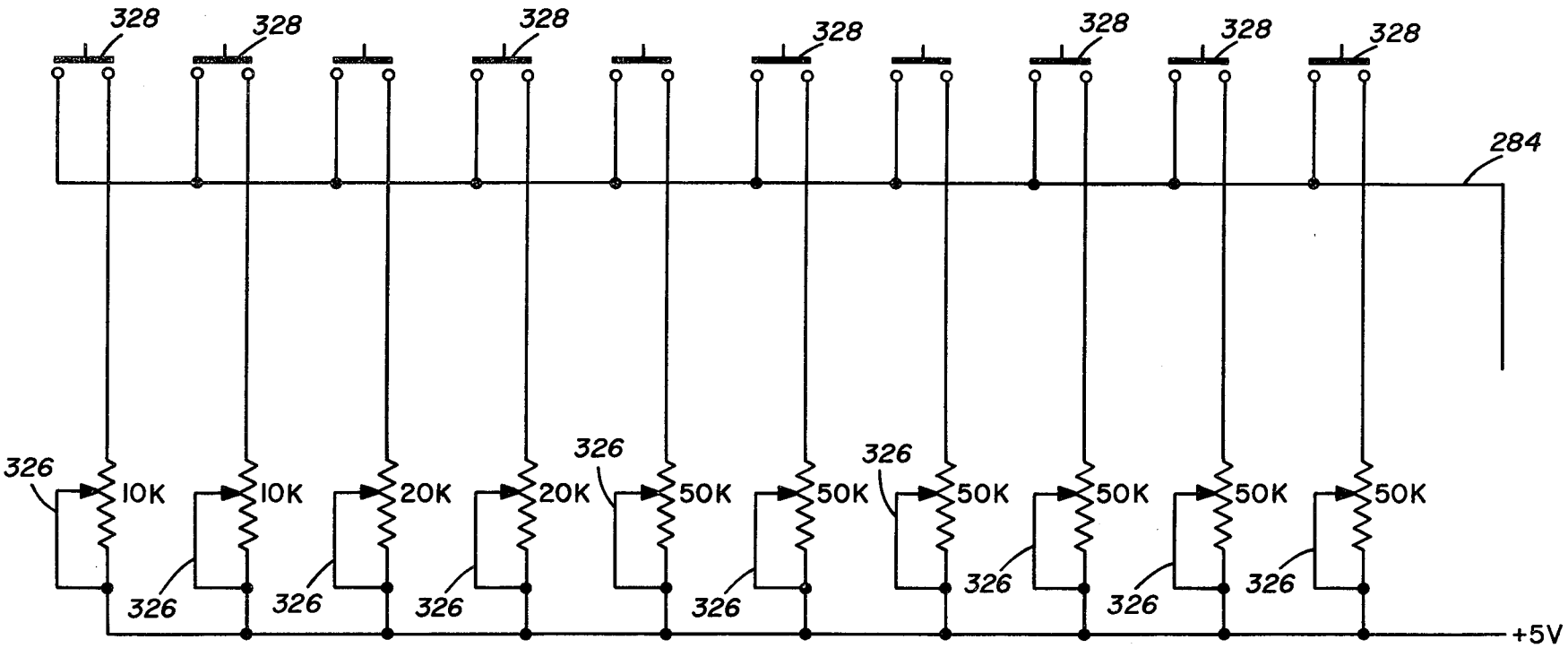
Figure 8D:
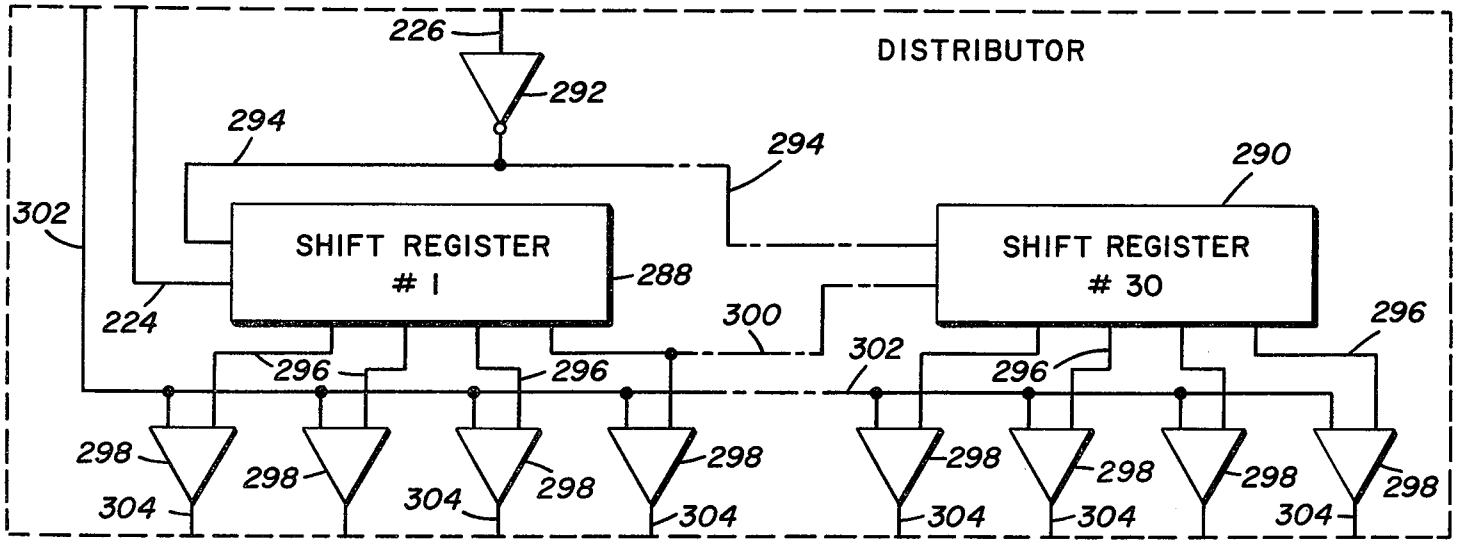

As shown in FIG. 8D, there is one group of thirty shift registers for storing the 120 bits of pattern data, only two of which, registers 288, 290, are specifically illustrated. The first shift register 288 receives pattern data over line 224 which is clocked in by clock pulses received over one line 226 and inverter 292, the output of which is fed to each of the shift registers over line 294. Each of the thirty shift registers has four output lines 296 for each of the four stored bits connected as one input to four respective operational amplifiers 298. The fourth state of the first shift register 288 is connected to the input of the second shift register, as is true with the second and third shift registers and so on in order to enable the 120 bits to be shifted down into the 30 registers. Each of the operational amplifiers 298 has its second input coupled to a strobe line 302, having a voltage which is used to operate, via amplifier output line 304, the various solenoid valves for a predetermined and variable firing time in accordance with the pattern information stored in the registers.

There are several important aspects of the strobe line voltage which will now be described. The four bits stored, for example, in shift register 288 represent a logic 0 or 1 and may correspond to 0 voltage and +5 voltage levels. As is known, the output of each of the operational amplifiers 298 will depend upon whether the voltage level on the line 296 is higher or lower than the voltage level on the strobe line 302. In the present specific embodiment, only if the voltage of the data bit exceeds the strobe line voltage, will the output of an amplifier be such as to activate a solenoid valve and allow dyestuff to flow through a corresponding nozzle onto the carpet tile. Also, the length of activation or firing time that the strobe line voltage is applied will control the amount of dyestuff applied to the carpet time. Furthermore, during loading of the bits into the shift registers none of the solenoid valves should be controlled by the pattern data; therefore, during this loading period a sufficiently high strobe line voltage level is provided to prevent amplifiers 298 from changing state and energizing the solenoid valves.

FIGS. 8B and 8C illustrate the circuitry for providing suitable strobe line voltages to carry out the above features. FIG. 8B shows thirteen identical disablers 306 for the solenoid values, one for each of the thirteen groups of 120 bits stored in a distributor 94 (FIG. 5). Each disabler 306 includes an operational amplifier 308 whose output is connected to a manual switch 310 having contacts 310*a*, 310*b* and 310*c*. One input of each of the amplifiers 308 is connected to a +3 volt source 312 over line 314. The voltage source 312 includes a series connection of five diodes 316, each having a voltage drop of 0.6 volts and connected between a source of +5 volts and ground. The other input of each of the amplifiers 308 is coupled via line 318 to the output of a NAND gate 320 whose one input is connected to a gun bar turn-off relay 322 over conductive path 324 and whose other input is coupled to the output of firing or activating multivibrator 278 (FIG. 8A) over line 286. Each of the disablers 306 also has an input connected to a +15 volt source over line 326. The output of each of the disablers 306 is the strobe line voltage on line 302 which is fed to the operational amplifiers 298 of a corresponding one of the thirteen groups of 120 bits.

FIG. 8C shows the circuitry for varying the length of time by which the strobe line voltage is applied to the amplifiers 298. This circuitry is capable of providing one of ten time periods for the application of the strobe line voltage and for varying such periods with a fine activation time adjustment means. The circuitry includes, connected in parallel, ten series connections of a variable resistor 326 and push button 328, each coupled between a +5 volt source and output line 284 and with the push button connected in common as shown. The activation time range for each of the series connections may be from a low range of 4.5–12 milliseconds to 4.5–47 milliseconds. Each of the resistors 326 will have a variable resistance to provide an activation time within one of the respective ranges.

As noted previously, the solenoid valves should not be energized during loading of the data bits into the thriteen groups of thirty shift registers, but only after all the bits have been stored and no further pattern data is to be received by a distributor 94 from the control panel 80. Consequently, during loading the strobe line 302 provides a voltage of +15 volts to the one input of each of the amplifiers 298. Since the data bits in each of the shift registers correspond to either 0 or +5 volts the amplifier 298 will not change state to provide a voltage sufficient to energize a solenoid valve.

During loading, retriggerable multivibrator 268 (FIG. 8A) is constantly retriggered by the clock pulses from receiver 198. Accordingly, firing or activating multivibrator 278 is not triggered, thereby not providing an output pulse over line 286. NAND gate 320, shown in FIG. 8B, will therefore not be enabled and the input over line 318 to the respective amplifiers 308 will be +5 volts. Since this +5 input voltage is greater than the +3 volts at the other input of the amplifiers 308, the output of these amplifiers will not change state; i.e., they will be at +15 volts. Accordingly, +15 volts are applied to output line 302 through contacts 310*a*, 310*c*to one of the inputs of amplifiers 298. Since the voltage of the data bits will not exceed +5 volts, operational amplifiers 298 cannot change state to enable the solenoid valves during loading. Furthermore, the relatively high +15 strobe line voltage will also prevent noise in the circuit from causing amplifiers 298 to switch during loading. Manual switch 310 may have its contacts 310*a* and 310*b* closed to disable a shift register and therefore one foot of a gun bar by means of the +15 volts on line 326.

After loading, no more clock pulses are received by retriggerable multivibrator 268; therefore, an output signal is provided over line 276 to fire multivibrator 278 at the negative transition of the such signal. Multrivibrator 278 then generates a firing pulse over line 286, the duration of which is proportional to the charge stored on capacitor 280 which is obtained through the circuitry shown in FIG. 8C. With one of the buttons 328 closed, and with a corresponding resistor 326 adjusted to a predetermined resistance, the charge will be stored on the capacitor 280 through such resistor 326, push button 328, line 284, and resistor 282. This output signal is then fed as one input to gate 320 (FIG. 8B) which, with the gun bar turn-off relay 322 closed, will be enabled to provide an output pulse on line 318 proportional to the duration of the signal on line 286. The output pulse from gate 320 will have a voltage of 0 volt which is applied to one of the inputs of amplifier 308. Since this voltage is less than the +3 volts supplied by source 312, amplifier 308 will change state to generate +2 volts. Consequently, a +2 volts strobe signal is applied over line 302 to one input of each of the amplifiers 298 (FIG. 8D). Since the other input to each of the amplifiers 298 will be 0 or +5 volts corresponding to the pattern data stored in the shift registers, amplifiers 298 will switch states in dependence on this data. To further ensure that the nozzles 52 of a gun bar 42 are not controlled in accordance with pattern data until all the shift registers of that gun bar are fully loaded, the output of retriggerable multivibrator 268 is in duration, after no clock pulses are received, approximately 25 microseconds to delay triggering of multivibrator 278.

Figure 9:
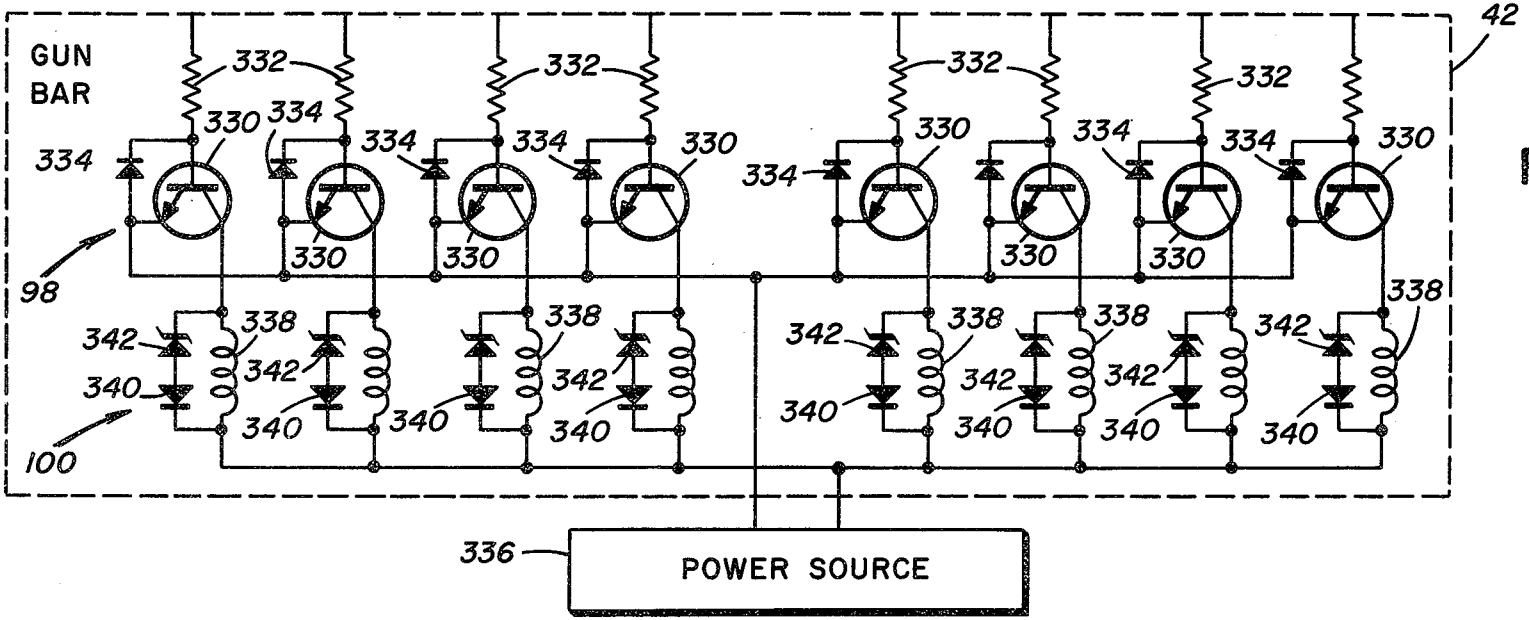
FIG. 9 is a schematic diagram of the gun bar connection panel and solenoid valve card of FIG. 5.

FIG. 9 discloses the schematic of the gun bar connection panel 98 and solenoid valve card 100. The gun bar connection panel 98 includes a series of NPN transistors 330, each connected to the output of one amplifier 298 through a resistor 332. The base and emitter of each transistor 330 are coupled by a diode 334 while the emitter of each transistor 330 is coupled to a power source 336. The collector of each transistor 330 is connected to one end of a solenoid 338 whose other end is coupled to the power source 336. A diode 340 and Zener diode 342 are connected in series across both ends of each solenoid 338.

If it is assumed that a data bit stored in the shift register 288 and applied to a corresponding amplifier 298 is a logic 1, then +5 volts is applied to this amplifier. Consequently, since the voltage on strobe line 302 is +2 bolts, amplifier 298 will change state and provide a positive output to turn on the associated transistor 330 for a period of time corresponding to the duration of the strobe line voltage. When this transistor 330 is on, current is drawn from the power source 336 through solenoid 338, transistor 330 and then back through the power source 336 to complete the circuit. This current, therefore, energizes the solenoid 338 causing it to close the corresponding valve 64, preventing air from deflecting the dyestuff flowing from nozzle 52 and dispensing a predetermined amount on the carpet tile.

If the data bit stored in the shift register 288 is a logic 0, then a 0 voltage is applied as one input to the amplifier 298 which will not switch states. Accordingly, a negative voltage is generated preventing transistor 330 from being turned on. Solenoid 338 is not energized, valve 64 is open and the air stream deflects the dyestuff from being applied to the carpet tile. The operation of the solenoid 338 occurs in a similar manner throughout all the other thirteen groups of 120 solenoids in a gun bar 42 to apply the dyestuff across a width of thirteen feet of carpet tile in accordance with the pattern data stored in the computer 69.

After the predetermined amount of dyestuff is applied to the carpet tile, as determined by the activation time or the duration of the firing pulse on line 286, +15 volts is again applied over the strobe line 302 to the amplifiers 298. This will cause de-energization of all the solenoids 338. To increase machine speed operation and to avoid applying dyestuff to an area of the carpet tile which is not desired, it is important to de-energize the solenoids 338 as quickly as possible, and this is accomplished through the use of the zener diode 342. When the strobe line voltage goes to +15 volts, the transistors 330 are turned off and the magnetic field in solenoids 338 collapses and tries to drive the one end of the solenoid connected to the collector more positive than the other end coupled to the power source 336. Though the one end is driven more positive, the zener diode limits it to, for example +25 volts with respect to ground, assuming the other end connected to the power source is at +15 volts. Thus, the one end can be driven more positive only by ten volts. This causes an inductive feedback through the coil 338 causing the magnetic field to collapse rapidly and resulting in the associated valve 64 closing more quickly.

If the conveyor belt is moving relatively fast, it is possible for the control panel 80 to request new pattern data from the computer 69 while a distributor 94 is causing dyestuff to be applied to the carpet tile in accordance with pattern data from the previous data requested. This condition is known as overspeed and may occur when a relatively long activation or firing time is set. That is, the conveyor 12 may have moved one-tenth inch to cause the electronic registration system 74 to generate an enabling pulse for the control panel 80 to request the new pattern data while the firing multivibrator 278 is generating an activation pulse of a relatively long period of time over line 286. This undesirable condition can be detected by the overspeed protection circuitry shown in FIG. 8B and may be corrected by either slowing down the speed of the conveyor belt or decreasing the activation time.

The overspeed detection circuitry includes a one shot multivibrator 344 having an input connected over path 348 to the output of NAND gate 346 and an output coupled via line 350 to a warning circuit 352. Gate 346 receives a clock input over line 288 from the output of receiver 198 shown in FIG. 8A and a second input which is the activation or firing pulse from multivibrator 278 over line 286.

If both clock and the firing pulses are received by the gate 346, it is an indication that the gun bar is firing at the same time that the distributor is receiving new pattern data. Under this condition, gate 346 will be enabled to provide an output pulse whose negative transition will trigger multivibrator 344. The output of multivibrator 344 then will be fed to the warning circuit 352 comprising first and second transistors 354, 356 whose collector and base, respectively, are connected as shown. Transistor 354 will be turned off by the pulse from multivibrator 344 and in turn will turn on transistor 356 to energize a warning device such as a lamp 358. When an operator sees this light 358 turned on, he may then decrease the activation time or lower the speed of the conveyor belt.

The above discussion has related to normal cycle operation. In such operation, when a line of carpet tile is beneath a gun bar, a predetermined amount of dyestuff is applied through the nozzles 52 in accordance with the pattern data stored in the computer. As already indicated, a uniform amount of dyestuff will be applied to this line of carpet tile. However, in the design pattern, it may be necessary to apply different dye concentrations on a given line of carpet tile to achieve the desired configuration. For example, the outer portions of the design on a given line may require a light green color whereas the inner portions may need a darker green. This difference in shade is accomplished with the split cycle operation of the present invention.

Figure 10A:
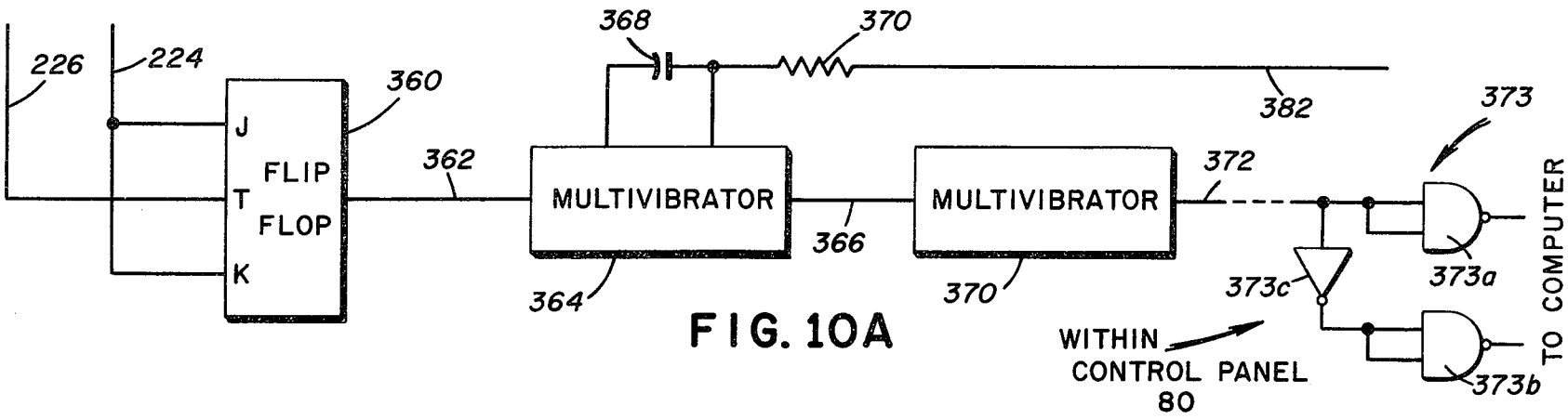
FIGS. 10A and 10B are schematic illustrations of cycle control circuitry.
Figure 10B:
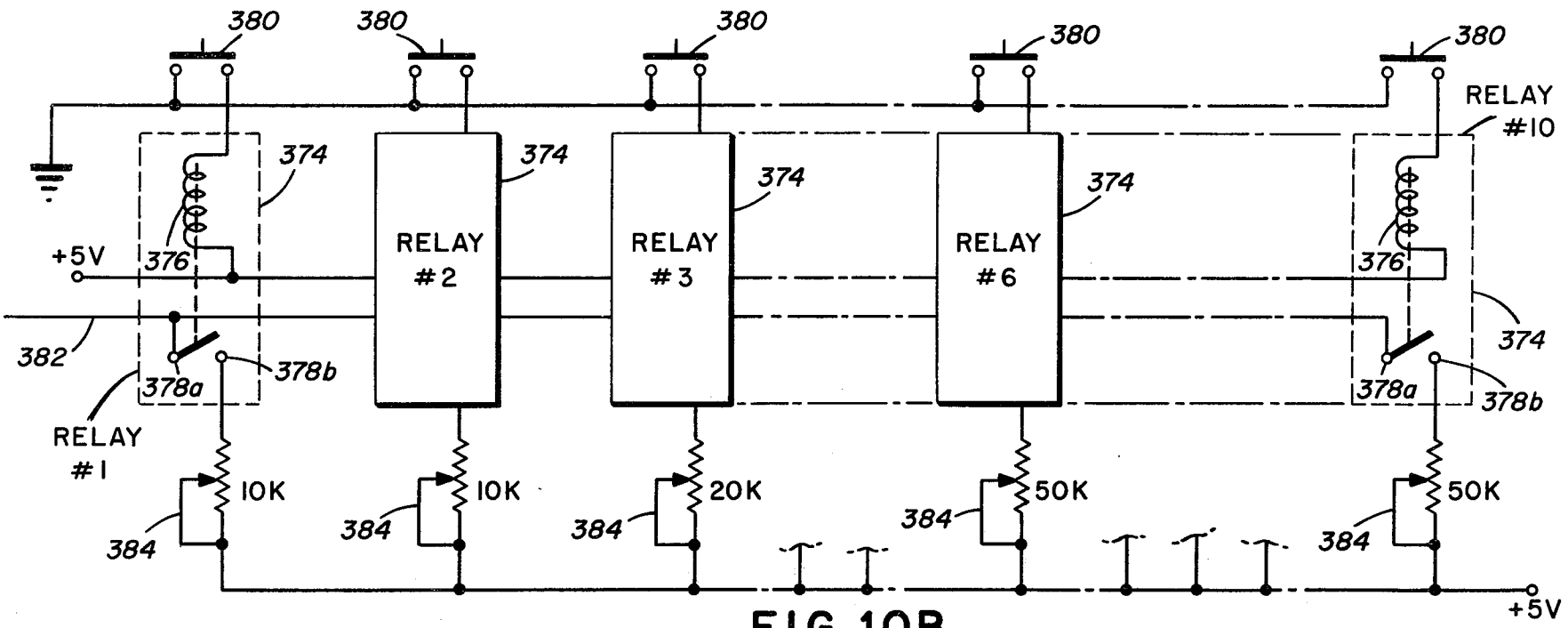

FIGS. 10A and 10B show, schematically, the cycle control circuitry for providing either normal or split cycle operation. This circuitry is required only for distributor No. 1 shown in FIG. 5. FIG. 10A shows a J-K flip-flop 360 having the J and K inputs connected to one of the lines 224 of decoder 212 (FIG. 8A) for receiving data bits and the T or trigger input connected to one of the lines 226 of decoder 216 (FIG. 8A) for receiving clock pulses. The specific lines 224, 226 shown in FIG. 10A transmit, respectively, the 8 extra or synchronization bits (i.e., the byte) shown in FIGS. 6A, 6B. The output of flip-flop 360 is fed via line 362 to a one shot multivibrator 364 which provides an output pulse over line 366. For reasons which will be described below, the duration or width of the output pulse of multivibrator 364 is equal to the maximum activation time of any one distributor 94 and is obtained by charging the capacitor 368 through a resistor 370 in a similar manner that capacitor 280 of multivibrator 278 is charged.

The output of multivibrator 364 is fed to another one shot multivibrator 370 which is activated at the negative transition of the signal on line 366. The output of multivibrator 370 is fed over line 372 to a differential line driver 373, including two NAND gates **373*a*, 373*b* and an inverter 373*c*, which is actually located in the main control panel 80 to request more pattern data for each of the eight distributors. The output of line driver 373 is fed to a differential line receiver (not shown) in the computer 69 similar to receivers 198, 204. The signal from such former receiver is transmitted to one input of an OR gate (not shown) in the computer whose output is used to enable the computer to output the pattern data. In this connection, a second line driver identical to driver 373 is located in the panel 80 to receive the enabling pulse from registration system 74 and to then send a signal to a second differential line receiver in the computer 69** whose output is fed to the second input of the OR gate to provide pattern data.

FIG. 10B discloses the circuitry for charging the capacitor 368 in accordance with the desired maximum activation time of any single distributor 94 and includes a split cycle time selector of ten relays 374, only two of which are shown schematically. Each relay 374 includes a coil 376 which, when energized, closes the contacts **378*a*, 378*b*. One end of each of the coils 376 is connected in common to a +5 volt source while the other end is coupled to one contact of a push button 380. The other contact of each of the buttons 380** is connected in common to ground.

Contacts **378*a* are connected in common over line 382 to resistor 370 shown in FIG. 10A. The other contacts 378*b* are connected in common to a +5 volt source through variable resistors 384. Each of these resistors 384 may be varied to set the charge on capacitor 368 in accordance with the maximum activation time of any one of the distributors 94**.

During normal cycle operation, the eight synchronization bits for each of the eight groups of 1568 bits are all logic 0, as shown in FIG. 6A. After being line decoded by decoder 212, these eight bits are fed via a line 224 to flip-flop 360. Since these bits are all 0's, the flip-flop 360 does not change state and no output is provided to activate multivibrator 386. Accordingly, multivibrator 370 is not triggered and no request for further pattern data is made until the next one-tenth inch travel of the conveyor 12, at which time registration system 74 will generate its enabling pulse. Consequently, a given line of carpet tile will receive a uniform amount of dyestuff.

In split cycle operation, as shown in FIG. 6B, the data format includes odd and even cycles in which the odd cycle will have at least one and preferably all of the eight synchronization bits as a logic 1. The eight synchronization bits of the even cycle will all be 0.

During the odd or first cycle of the split cycle, the eight synchronization bits of data and clock are line decoded by data decoder 212 and clock decoder 216 and fed via one of the lines 224, 226 to flip-flop 360. When a 1 data bit appears at the J-K terminals, flip-flop 360 is triggered at the T terminal by the clock, thereby causing the flip-flop to change state and generate an output signal which will trigger multivibrator 364. Multivibrator 364 then generates a signal whose duration is equal to the maximum activation time of any one distributor 94 as provided by capacitor 368. This signal at its negative going transition, then triggers multivibrator 370, which provides an enabling pulse for requesting pattern data for the even cycle for all the distributors 94.

Computer 69 will then output additional pattern data which will be demultiplexed by the control panel 80 and line decoded by the various distributors 94 to control the nozzles 52. Since this even cycle of data has synchronization bits which are all 0, the state of flip-flop 360 will be such that no output pulse is provided to multivibrator 364 and, hence, no enabling pulse will be generated by multivibrator 370 to request pattern data. Only until the conveyor has moved one-tenth inch and the registration system 74 has enabled the control panel 80, will the gun bars 42 receive additional pattern information from computer 69.

To obtain an output from multivibrator 364 equal to the maximum activation or firing time of any one distributor, one of the push buttons 380 shown in FIG. 10B will be closed to complete a circuit through the +5 volt source, coil 376, the push button 380 and ground thereby energizing coil 376 and closing contacts 378*a*, 378*b*. As a result, a circuit is closed through a +5 volt source, variable resistor 384, contacts 378*a*, 378*b*, line 382, resistor 370 and capacitor 368 to charge the latter. As can be appreciated, the particular push button 380 which is closed will correspond to that relay 374 and resistor 384 which will provide the required activation time. During normal cycle operation the particular push button 380 is opened, coil 376 is de-energized and other contacts (not shown) are closed to complete a circuit which maintains flip-flop 360 set.

In split cycle operation, the odd cycle of pattern data provides information to dispense a predetermined amount of dyestuff to a line of carpet tile. During the even cycle, the pattern data provides information to apply additional dyestuff to required areas of such line of carpet tile, thereby increasing the concentration in those areas and providing various shades of a particular color.

In split cycle operation, the even cycle data should not be requested while any one of the distributors 94 is firing in accordance with the odd cycle data stored in the shift registers. Otherwise, even cycle pattern data will be shifted into the registers before the data from the odd cycle is used to apply the desired amount of dyestuff. To prevent this, as noted above, the output pulse from multivibrator 364 has a width equal to the maximum activation time of any one distributor and advantage is taken of the fact that there is approximately a 1 millisecond delay for loading of the data into one of the eight distributors 94.

More specifically, the information demultiplexed by control panel 80 is first loaded into distributor No. 1 and takes approximately 1 millisecond. Then, the demultiplexed data is loaded into distributor No. 2 and this takes another millisecond, there being, therefore, a 2 millisecond delay between the time data is first loaded in distributor No. 1 and then loaded in distributor No. 2. This continues so that there will be approximately an eight millisecond delay between the time distributors No. 1 nd No. 8 are loaded. If, for example, the maximum activation time of a distributor 94 is 10 milliseconds and is set for distributor No. 3, then no even cycle data will be received by this distributor No. 3 before it has completed firing. When distributor No. 1 receives the odd cycle data, multivibrator 364 generates an output pulse having a duration of 10 milliseconds. After 2 milliseconds of firing by distributor No. 1, distributor No. 3 is loaded and commences firing for 10 milliseconds. After 6 more milliseconds distributor No. 1 may be ready for loading even cycle data (if its activation time is only 8 milliseconds); however, there are still 2 milliseconds of pulse duration remaining from multivibrator 364(and 4 milliseconds of firing time left in distributor No. 3). Then, after 2 more milliseconds multivibrator 370 is triggered and even cycle data is requested, with distributor No. 3 having only 2 milliseconds of firing time left. Finally, after 2 more milliseconds even cycle data will be shifted into the registers of distributor No. 3 just as it has completed firing the odd cycle data. With this split cycle operation, and in view of the time delay in storing pattern data in the registers of the eight distributors 94, even cycle data can be requested while the distributors are still firing the odd cycle data. This will enable the desired pattern to be resolved to a very high degree since the conveyor will have moved an almost infinitesimal distance before more dyestuff is applied to increase the concentration along certain areas of a given line of carpet tile.

Normal cycle patterns will fire once each machine cycle; i.e., each one-tenth inch travel of the conveyor 12, for the amount of activation time selected. However, split cycle patterns fire twice within a machine cycle for the amount of time selected. Consequently, valve activation time is doubled for any selected firing time and, therefore, the speed of the conveyor should be reduced in dependence on the maximum activation time and conveyor speed during normal cycle operation.

Each of the gun bars 94 is continuously operating and may be separated by, for example, ten inches. Consequently, the pattern data in the computer 69 must be spaced on the magnetic tape a distance equal to the time it takes a line of carpet tile to move the 10 inches from one gun bar to the next. Thus, if gun bar No. 1 applies red dyestuff and gun bar No. 2 dispenses green dyestuff, and two adjacent areas on the line of carpet tile are to receive red and green dyestuff, respectively, then the data stored in the computer will be spaced such that when those areas are under gun bar No. 1, red dyestuff will be applied to one area and after that line of tile travels 10 inches, green dyestuff will be applied to the other area.

What is claimed is:

1. In apparatus for dyeing and printing textile material to form a pattern thereon including a conveyor for moving the textile material in a path of travel, a plurality of applicator means positioned along the conveyor, each said applicator means applying plural streams of liquid to the material during its passage thereby, means for storing pattern data, and means for periodically generating an enabling signal, the time between enabling signals being one cycle of operation, said storage means reading out said data in response to said enabling signal, the improvement comprising an electronic control system means for controlling said plural streams of liquid in accordance with the pattern data stored in said storage means, said electronic control system means comprising:

a. means for receiving during one cycle a block of pattern data from said storage means, said block including pattern data for each of said plurality of applicator means, said receiving means including a plurality of first output lines equal to said plurality of applicator means and means for routing said data to said first output lines;

b. a plurality of means, each having a first input connected to one of said first output lines and a plurality of second output lines equal to the number of said plural streams, for providing output signals on said second output lines corresponding to said pattern data on said first output lines, the duration of said output signals extending for a predetermined time period; and c. a plurality of means, each having a second input connected to one of said second output lines, for individually directing said plural streams of liquid from said applicator means in accordance with said output signals whereby a predetermined amount of liquid is applied to said material.

2. The apparatus of claim 1 further comprising split cycle control means for enabling the control of the application of liquid to the material a plurality of times within said one cycle in accordance with a plurality of blocks of pattern data.

3. The apparatus of claim 2 wherein said split cycle control means comprises means for generating an enabling pulse at the completion of said output signals, said receiving means being responsive to said enabling pulse to request additional pattern data from said storage means.

4. The apparatus of claim 3 wherein each of said means for providing output signals includes means for varying the duration of said output signals and wherein said means for generating an enabling pulse includes means for preventing the generation of said enabling pulse until said output signals of longest duration are completed.

5. The apparatus of claim 1 further comprising overspeed control means for determining if the duration of said output signals is too long in relation to the speed of travel of said conveyor, said overspeed control means including means for generating a warning signal if an overspeed condition exists.

6. The apparatus of claim 5 wherein said means for providing includes means for varying the duration of said output signals.

7. An apparatus for dyeing and printing textile materials to form a pattern thereon including a conveyor for moving the textile material in a path of travel, a plurality of applicator means positioned along the conveyor, each said applicator means applying plural streams of liquid to the textile materal during its passage thereby, electronic registration system means for generating an enabling signal each time the conveyor has traveled a predetermined distance, the time between enabling signals being one cycle, and pattern data storage means, the improvement comprising an electronic control system means for controlling said plural streams of liquid in accordance with pattern data stored in said storage means, said electronic control system means comprising:

a. control panel means for requesting and receiving during one cycle a block of pattern data in serial bit format, said panel means being responsive to said enabling signal to request said block of data, said panel means demultiplexing said block of data into groups of data, there being of said groups of data for each of the applicator means;

b. a plurality of distributor means, each receiving one group of pattern data, for generating a plurality of output signals of a predetermined duration, each of said output signals corresponding to a data bit; and c. a plurality of means, each regulating one of said plural streams and each responsive to one of said output signals, for individually directing said plural streams of liquid from said applicator means.

8. The apparatus of claim 7 wherein each of said distributor means comprises:

a. a plurality of shift registers for storing each of the data bits;

b. a strobe line voltage generating means for generating a signal of predetermined voltage; and c. a plurality of switching means, each said switching means having a first input connected to a stage in one of the shift registers which stores a data bit and a second input connected to said voltage generating means, each said switching means providing one of said output signals in response to the voltages on said first and second inputs.

9. The apparatus of claim 8 wherein said strobe line voltage generating means includes means for generating a voltage for a predetermined period of time and wherein the duration of said output signals is proportional to said predetermined period of time.

10. The apparatus of claim 9 wherein said voltage generating means includes means for varying said predetermined period of time.

11. The apparatus of claim 9 wherein said strobe line voltage generating means includes means for generating a voltage of sufficiently high level during loading of the data bits in said shift registers to prevent said plurality of switching means from providing said output signals.

12. The apparatus of claim 8 wherein said block of data includes a synchronization bit and further comprising split cycle control means including means for detecting said synchronization bit and for generating an output pulse in response thereto, means, responsive to said output pulse, for generating a further signal whose duration is equal to the duration of said output signals and means, responsive to said further signal, for generating an enabling pulse, said control panel means being responsive to said enabling pulse to request additional pattern data during said one cycle.

13. An apparatus for dyeing and printing textile material to form a pattern thereon including means for moving the material in a path of travel, means for storing pattern data and first means for periodically generating an enabling signal, the time between enabling signals being one cycle of operation, said storing means reading out a block of said data in response to said enabling signal, comprising:

a. means for applying a stream of dyestuff to the material in accordance with said block of pattern data;
b. electronic control means for receiving said block of pattern data when read out from the staring means and for transmitting said data to said means for applying;
c. means for detecting when said means for applying has completed applying the dyestuff in accordance with said block of pattern data; and
d. second means, responsive to said detecting means, for generating an enabling signal during said one cycle of operation to request an additional block of pattern data from said storing means.

14. An apparatus for dyeing and printing textile material to form a pattern thereon including means for moving the material in a path of travel, comprising:

a. means for storing pattern data for forming the pattern;
b. first means for periodically generating an enabling signal, the time between enabling signals being one cycle of operation, said storing means reading out a block of said data in response to said enabling signal, the block having data to form a part of the pattern;
c. means for applying a stream of dyestuff to the material in accordance with said block of pattern data;
d. electronic control means for receiving said block of pattern data when read out from the storing means and for transmitting said block of pattern data to said means for applying;
e. means for detecting when said means for applying has completed applying the dyestuff in accordance with said block of pattern data; and
f. second means, responsive to said detecting means, for generating an enabling signal during said one cycle of operation to request an additional block of pattern data from said storing means.

15. An apparatus for dyeing and printing textile material to form a pattern thereon, comprising:

a. means for storing and periodically reading out pattern data;
b. means for applying dyestuff to a predetermined area of said material in accordance with said data;
c. electronic control means for receiving said pattern data and for routing said data to said means for applying; and
d. means for varying the time that said data is effective to control the application of dyestuff by said means for applying to vary the amount of dyestuff applied to said predetermined area; said varying means including means, having a first input which receives said data and a second input which receives a control signal of predetermined duration, for generating an output signal corresponding to said data, the duration of said output signal being dependent on the duration of said control signal, and means for generating said control signal of a predetermined duration.

16. The apparatus of claim 16 wherein said control signal generating means includes a capacitor and means for varying the charge stored in said capacitor.

17. Apparatus for applying dyestuff on material to form a pattern thereon, comprising:

a. means for storing pattern data;
b. means for moving the material along a path of travel;
c. a plurality of gun bar means, spaced apart along the path of travel, and each extending across the width of the material to provide plural streams of dyestuff on predetermined areas of a line of the material in accordance with said pattern data;
d. means for periodically requesting said pattern data from said storing means as the material is moved and transferring said data to said plurality of gun bar means to provide a first predetermined amount of dyestuff on predetermined areas of respective lines of the material; and
e. means for enabling said requesting and transferring means to request and transfer additional pattern data within one period to provide a second predetermined amount of dyestuff on at least one of the predetermined areas of at least one of the respective lines of material receiving the first predetermined amount of dyestuff.

18. Apparatus for applying dyestuff on textile material to form a pattern thereon, comprising:

a. means for storing data including pattern data and control data;
b. means for moving the material along a path of travel;
c. a plurality of gun bar means, spaced apart along the path of travel, and each extending across the width of the material to provide plural streams of dyestuff on predetermined areas of a line of the material in accordance with said pattern data;
d. means for periodically receiving said pattern data and control data from said storing means as the material is moved and transferring said pattern data to said plurality of gun bar means to provide a first predetermined amount of dyestuff on predetermined areas of respective lines of the material; and
e. means, responsive to said control data received by said receiving means, for enabling said receiving means to receive and transfer additional pattern data within one period to provide a second predetermined amount of dyestuff on at least one of the predetermined areas of at least one of the respective lines of material receiving the first predetermined amount of dyestuff.

19. Apparatus according to claim 18, wherein said enabling means comprises:

a. first means, receiving said control data, for generating a first signal of predetermined duration; and
b. second means, connected to said first generating means, for generating a second signal at the end of said first signal, said receiving means being responsive to said second signal.

20. Apparatus according to claim 19 wherein said first means for generating comprises a flip-flop which changes state when said control data is of a certain level, and a first multivibrator responsive to the change of state of said flip-flop.

21. Apparatus according to claim 20 wherein said second means for generating comprises a second multivibrator connected to said first multivibrator.

22. Apparatus according to claim 19 wherein said receiving and transferring means includes a plurality of control means each controlling one of said gun bar means for a preset period of time with said received pattern data to provide the first predetermined amount of dyestuff on respective lines of the material.

23. Apparatus according to claim 22 wherein said first signal has a predetermined duration corresponding to the maximum period of time by which said gun bar means is controlled by said control means.

24. Apparatus according to claim 23 wherein said first signal has a duration equal to the maximum preset period.

25. Apparatus according to claim 24 wherein said first means for generating includes a capacitor, and means for charging said capacitor, the charge on said capacitor corresponding to the duration of said first signal.

* * * * *

UNITED STATES PATENT OFFICE

CERTIFICATE OF CORRECTION

Patent No. 4,033,154 Dated July 5, 1977

Inventor(s) Harold L. Johnson

It is certified that error appears in the above-identified patent and that said Letters Patent are hereby corrected as shown below:

Column 1, line 19, delete "have" and insert therefor --has--.

Column 2, line 40, delete "shown" and insert therefor --show--.

Column 6, line 39, delete "sot" and insert therefor --shot--.

Column 7, line 65, delete "receive" and insert therefor --received--.

Column 19, line 19, delete "staring" and insert therefor --storing--.

Column 20, line 7, delete the numeral "16" and insert therefor --15--.

Column 20, line 45, after "and" insert the word --said--.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*